US011572746B2

(12) United States Patent
Becker et al.

(10) Patent No.: US 11,572,746 B2
(45) Date of Patent: Feb. 7, 2023

(54) ROTARY GRIPPING APPARATUS FOR A POWER TONG

(71) Applicant: Weatherford Technology Holdings, LLC, Houston, TX (US)

(72) Inventors: Arne Tjark Becker, Houston, TX (US); Kevin Wood, Houston, TX (US)

(73) Assignee: Weatherford Technology Holdings LLC, Houston, TX (US)

( * ) Notice: Subject to any disclaimer, the term of this patent is extended or adjusted under 35 U.S.C. 154(b) by 615 days.

(21) Appl. No.: 16/657,572

(22) Filed: Oct. 18, 2019

(65) Prior Publication Data

US 2021/0115741 A1 Apr. 22, 2021

(51) Int. Cl.
*E21B 19/16* (2006.01)

(52) U.S. Cl.
CPC ..... *E21B 19/161* (2013.01)

(58) Field of Classification Search
CPC ..... E21B 19/161
See application file for complete search history.

(56) References Cited

U.S. PATENT DOCUMENTS 2,846,909 A * 8/1958 Mason ..... E21B 19/164 81/57.2
3,147,652 A 9/1964 George
3,704,638 A 12/1972 Nicolson et al.
3,875,826 A 4/1975 Dreyfuss et al.
4,250,773 A * 2/1981 Haynes ..... E21B 19/164 81/57.2
4,346,629 A 8/1982 Kinzbach
4,593,584 A * 6/1986 Neves ..... E21B 19/164 81/57.18
4,867,236 A 9/1989 Haney et al.
5,435,213 A 7/1995 Buck
5,501,107 A 3/1996 Snyder et al.
5,669,653 A 9/1997 Penisson
6,050,156 A 4/2000 Buck
6,070,500 A * 6/2000 Dlask ..... E21B 19/161 81/57.33
6,223,629 B1 5/2001 Bangert
6,237,445 B1 5/2001 Wesch, Jr.
6,330,911 B1 12/2001 Allen et al.
7,090,254 B1 8/2006 Pietras et al.
(Continued)

FOREIGN PATENT DOCUMENTS

WO 2004079148 A2 9/2004
WO 2008103957 A1 8/2008
(Continued)

OTHER PUBLICATIONS

International Search Report and Written Opinion in related case PCT/US2020/055701 dated Dec. 4, 2020.

*Primary Examiner* — Aaron L Lembo
(74) *Attorney, Agent, or Firm* — Smith IP Services P.C.

(57) ABSTRACT

A power tong including a rotary gripping apparatus having a rotary base having a first jaw and at least one rotary arm movable relative to the rotary base between an open position and a closed position, the at least one rotary arm having a second jaw. A gap is present between the rotary base and the at least one rotary arm for receiving the tubular when the at least one rotary arm is in the open position. The gap is closed when the at least one rotary arm is in the closed position.

20 Claims, 23 Drawing Sheets

(56) References Cited

U.S. PATENT DOCUMENTS

| | | | | |
|---|---|---|---|---|
| 7,114,235 | B2 | 10/2006 | Jansch et al. | |
| 7,255,025 | B2 | 8/2007 | Dagenais et al. | |
| 7,621,202 | B2 * | 11/2009 | Bouligny, Jr. | E21B 19/161 81/57.33 |
| 8,453,541 | B2 | 6/2013 | Dagenais et al. | |
| 9,657,539 | B2 | 5/2017 | Gupta et al. | |
| 10,100,593 | B2 | 10/2018 | Musemeche | |
| 10,392,879 | B2 * | 8/2019 | Wood | E21B 19/161 |
| 10,472,905 | B2 * | 11/2019 | Smith | E21B 19/161 |
| 2002/0088674 | A1 | 7/2002 | Wassenhoven | |
| 2003/0177870 | A1 | 9/2003 | Neves et al. | |
| 2005/0188794 | A1 | 9/2005 | Schulze-Beckinghausen | |
| 2006/0196316 | A1 | 9/2006 | Slettedal et al. | |
| 2007/0074606 | A1 | 4/2007 | Halse | |
| 2008/0257116 | A1 | 10/2008 | Vatne | |
| 2009/0235786 | A1 | 9/2009 | Stensland | |
| 2009/0272233 | A1 | 11/2009 | Musemeche | |
| 2009/0277308 | A1 | 11/2009 | Light et al. | |
| 2010/0083796 | A1 | 4/2010 | Nelson | |
| 2011/0030512 | A1 | 2/2011 | Begnaud, Jr. | |
| 2011/0067529 | A1 | 3/2011 | Pietras et al. | |
| 2015/0275597 | A1 * | 10/2015 | Thibodeaux | E21B 19/164 81/57.33 |
| 2016/0356104 | A1 | 12/2016 | Vierke et al. | |

FOREIGN PATENT DOCUMENTS

| | | | |
|---|---|---|---|
| WO | 2018057075 | A1 | 3/2018 |
| WO | 2018164664 | A1 | 9/2018 |

* cited by examiner

ROTARY GRIPPING APPARATUS FOR A POWER TONG

BACKGROUND

Field

Embodiments of the present disclosure generally relate to a rotatable gripping apparatus for a power tong to make-up or break-out a connection between tubulars.

Description of the Related Art

It is known in the oil and gas industry to use power tongs with a rotatable gripping apparatus having jaws to make-up or break-out a connection between tubulars. The rotatable gripping apparatus of a conventional power tong have a gap that allows a tubular to be placed into and out of the gripping apparatus for a make-up or break-out operation. This gap, however, remains present during make-up and break-out and prevents a jaw from being placed into engagement with the tubular at the location of the gap. Additionally, when conventional active jaws of power tongs engage a tubular, the active jaws are moved laterally along a direction that is offset from the radius of the tubular. The lateral movement wastes clamping force and can result in the jaws galling the pipe and/or failing to achieve a proper grip necessary to complete a make-up or a break-out operation.

There is a need for a rotatable gripping apparatus for a power tong that has an opening that can open or close to allow ingress or egress of the tubular. There is also a need for a power tong that can extend jaws into engagement with a tubular with a substantially radial movement.

SUMMARY

The present disclosure generally relates to power tong having a rotary gripping apparatus and methods for completing operations with the power tong.

In some embodiments, the power tong for handling a tubular includes a rotary gripping apparatus having a rotary base having a first jaw and at least one rotary arm movable relative to the rotary base between an open position and a closed position, the at least one rotary arm having a second jaw. A gap is present between the rotary base and the at least one rotary arm for receiving the tubular when the at least one rotary arm is in the open position. The gap is closed when the at least one rotary arm is in the closed position.

A rotary gripping apparatus for a power tong including a jaw carrier having a passive jaw assembly. The passive jaw assembly includes a passive jaw, and an active jaw movable from a retracted position to an extended position. The rotary griping apparatus further includes a cam body disposed about the jaw carrier and rotatable relative to the cam body. The cam body includes a cam base having a cam configured to radially extend the active jaw from the retracted position to the extended position, and a cam arm movable relative to the cam base. The passive jaw assembly is movable with the cam arm relative to the cam base to create an opening in the cam body.

A method of rotating a tubular with a power tong including opening a rotary gripping apparatus to receive the tubular, wherein the rotary gripping apparatus includes a jaw carrier including at least one active jaw and a cam body. The method further includes inserting the tubular into the open rotary gripping apparatus. The method further includes closing the rotary griping apparatus. The method further includes rotating the cam body relative to the jaw carrier to radially extend the at least one active jaws into engagement with the tubular. The method further includes rotating the tubular gripped by the at least one active jaws.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

FIG. 2A illustrates the rotary gripping apparatus 200 in a closed configuration. FIG. 2B illustrates the rotary gripping apparatus 200 in an exemplary open configuration. FIG. 2C illustrates another view of the rotary gripping apparatus 200 in the closed configuration to better illustrate a brake 280. FIG. 2D is a cross-sectional view of FIG. 2A.

FIG. 7B-7C illustrate top view of FIG. 7A with the passive jaw assemblies 242*a,b* in different position. FIG. 8A is a partial side view of FIG. 7B. FIG. 8B is a partial side view of FIG. 7C. FIG. 8C is a partial side view of FIG. 7C.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
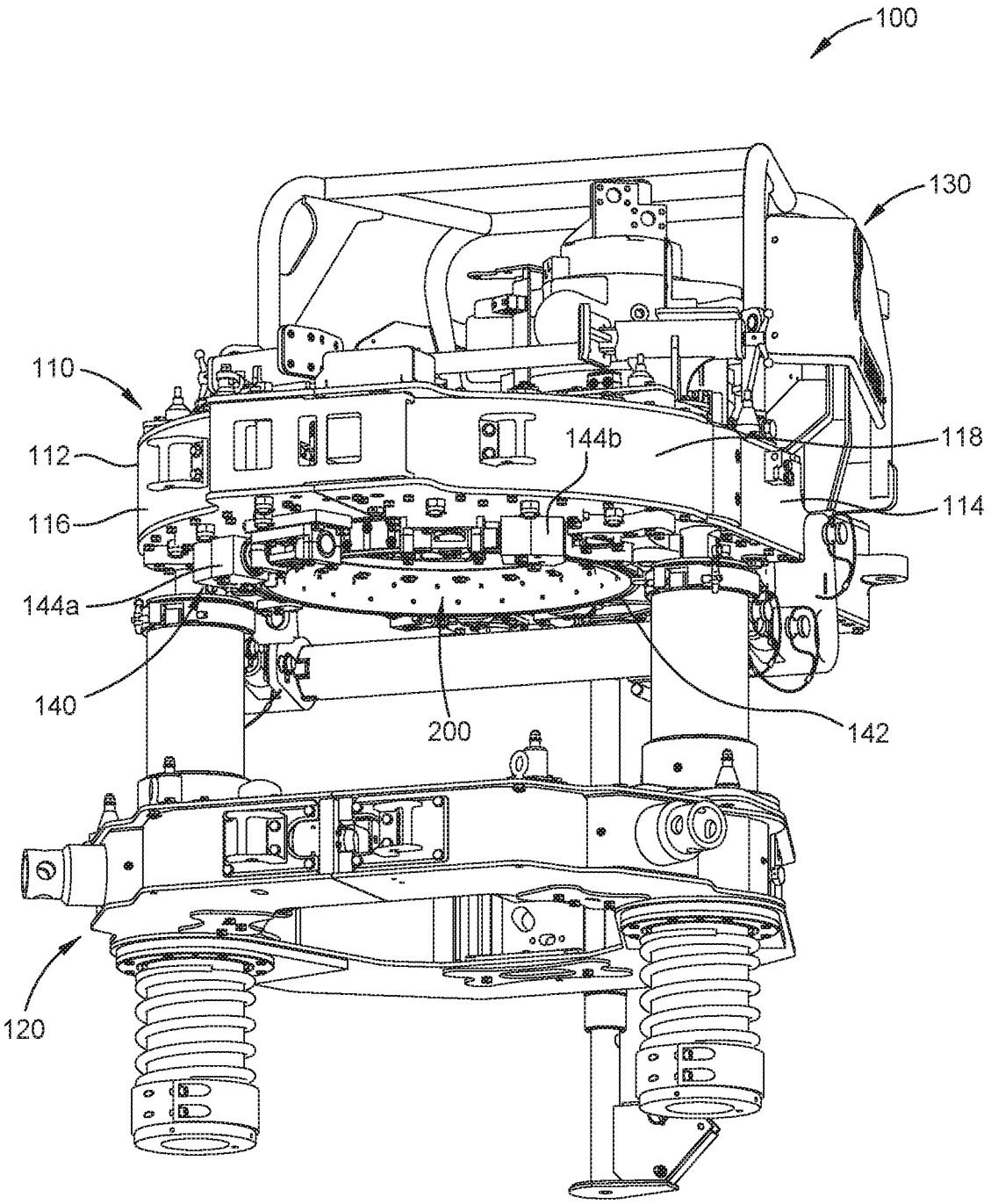
FIG. 1 illustrates a tong assembly 100.

FIG. 1 illustrates a tong assembly 100 having a power tong 110, a backup tong 120, and a motor unit 130. The power tong 110 has a rotary gripping apparatus 200 that is used to grip a tubular for make-up or break-out operations. A drive gear of the power tong 110 rotates the rotary gripping apparatus 200 about a central axis during a make-up or break-out operation. In some embodiments, and as shown in FIG. 1, the rotary gripping apparatus 200 is housed in a tong body 112 of the power tong 110. The tong body 112 has a base body 114, a first body arm 116, and a second body arm 118. The first body arm 116 and the second body arm 118 are moveable from a closed position (shown in FIG. 1) to an open position to convert the rotary gripping apparatus 200 from a closed configuration to an open configuration, and vice versa, to facilitate placing a tubular into the rotary gripping apparatus 200 or to remove a tubular from the rotary gripping apparatus 200. The power tong 110 additionally has a brake band assembly 140, which includes a brake band 142 and one or more actuators 144. In some embodiments as shown in FIG. 1, the brake band assembly 140 is disposed on an underside of the power tong 110. The brake band assembly 140 selectively applies a brake force to a brake 280 of the rotary gripping apparatus 200. The one or more actuators 144, such as first and second actuators 144*a,b*, are configured to move the brake band 142 into engagement or disengagement with the brake 280. As shown in FIG. 1, the first actuator 144*a* may be disposed on the first body arm 116, and the second actuator 144*b* may be disposed on the second body arm 118.

Figure 2A:
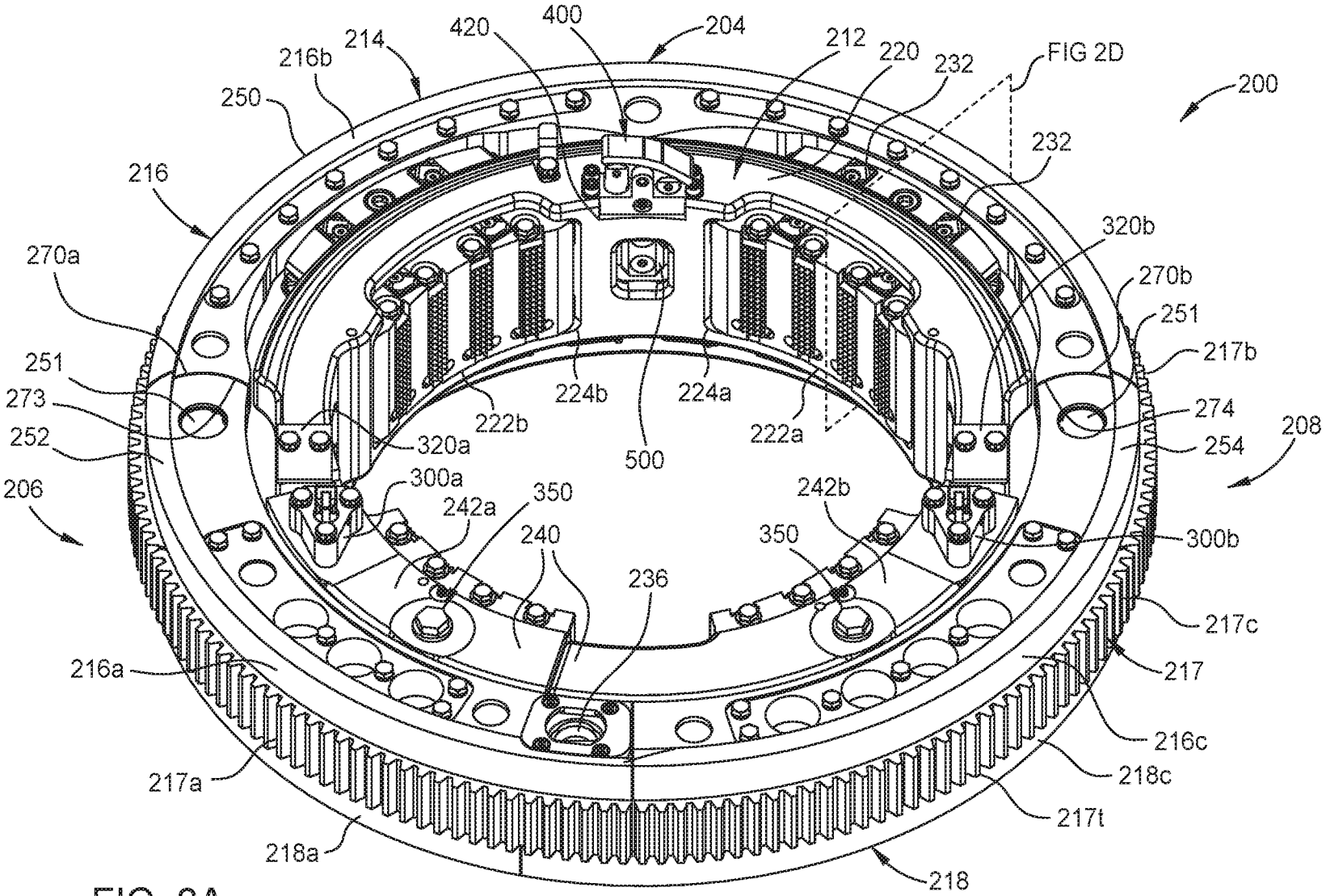
FIG. 2A-2D illustrate a rotary gripping apparatus 200.

FIGS. 2A-2D illustrate an embodiment of the rotary gripping apparatus 200. The rotary gripping apparatus 200 includes a rotary base 204, a first rotary arm 206, and a second rotary arm 208. When the rotary gripping apparatus 200 is in the neutral alignment as shown in FIG. 2A, the first rotary arm 206 and the second rotary arm 208 are pivotable relative to the rotary base 204 from a closed position to an open position to form a gap 210, and from the open position to the closed position to close the gap 210.

Figure 2B:
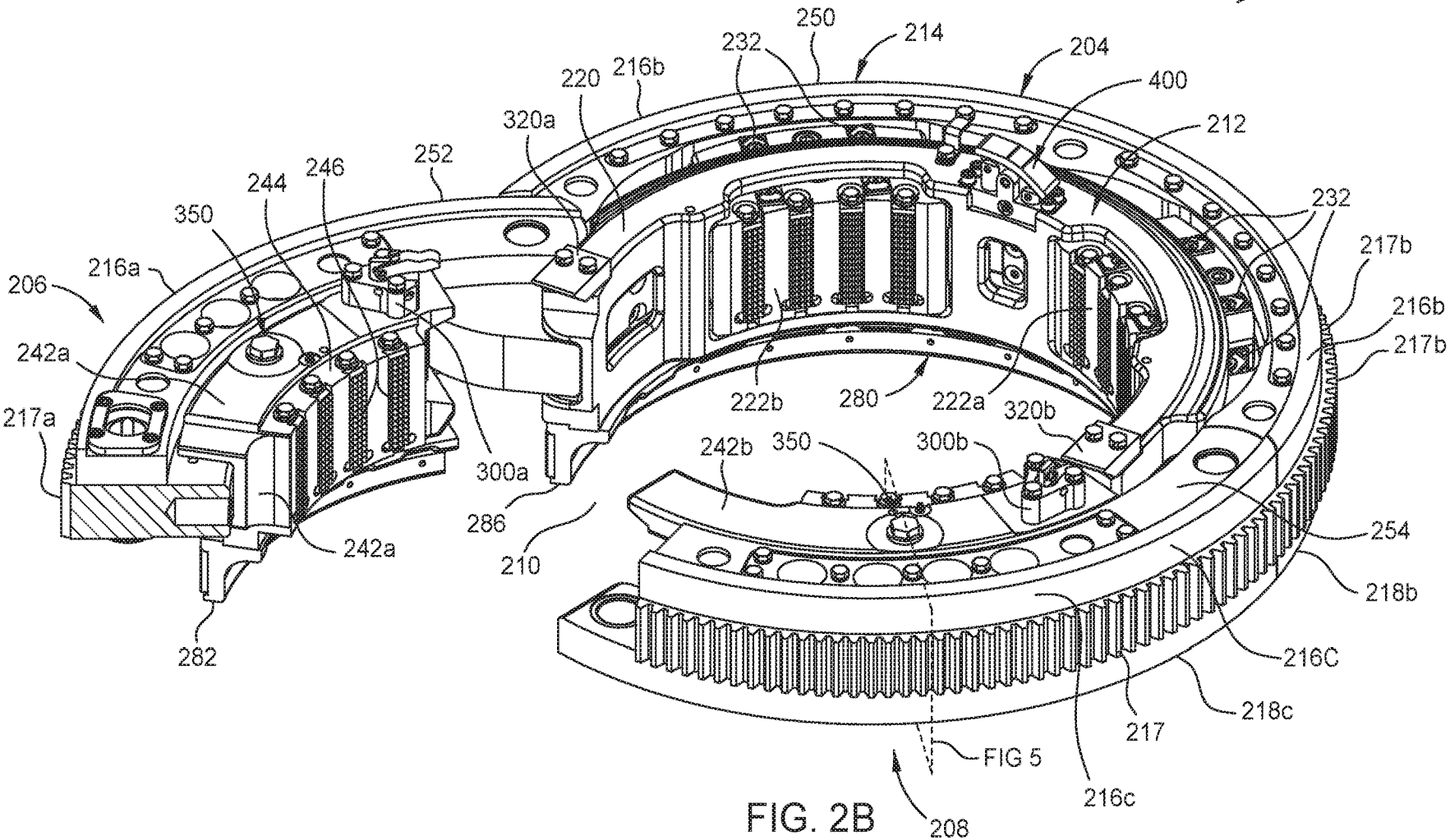

When the rotary gripping apparatus 200 is in the closed configuration, as shown in FIG. 2A, the first rotary arm 206 and the second rotary arm 208 are in their respective closed positions such that the rotary gripping apparatus 200 is an enclosed ring. The rotary gripping apparatus 200 is ready to make-up or break-out a tubular connection when in the closed configuration. The rotary gripping apparatus 200 is in the open configuration when at least one of the first and second rotary arms 206, 208 is moved to the open position. FIG. 2B illustrates an example of an open configuration, where the first rotary arm 206 is in the open position but the second rotary arm 208 remains in the closed position. However, it is contemplated that both the first rotary arm 206 and the second rotary arm 208 can be in the open position when the rotary gripping apparatus 200 is in the open configuration. When the rotary gripping apparatus 200 is in the open configuration, the rotary gripping apparatus 200 is an open ring having the gap 210. A tubular may be inserted into or removed from the rotary gripping apparatus 200 via the gap 210. Once the tubular has cleared the gap 210, the respective first and/or second rotary arms 206, 208 that are in the open position are moved back to the closed position to close the gap 210 and return the rotary gripping apparatus 200 to the closed configuration.

Figure 2C:
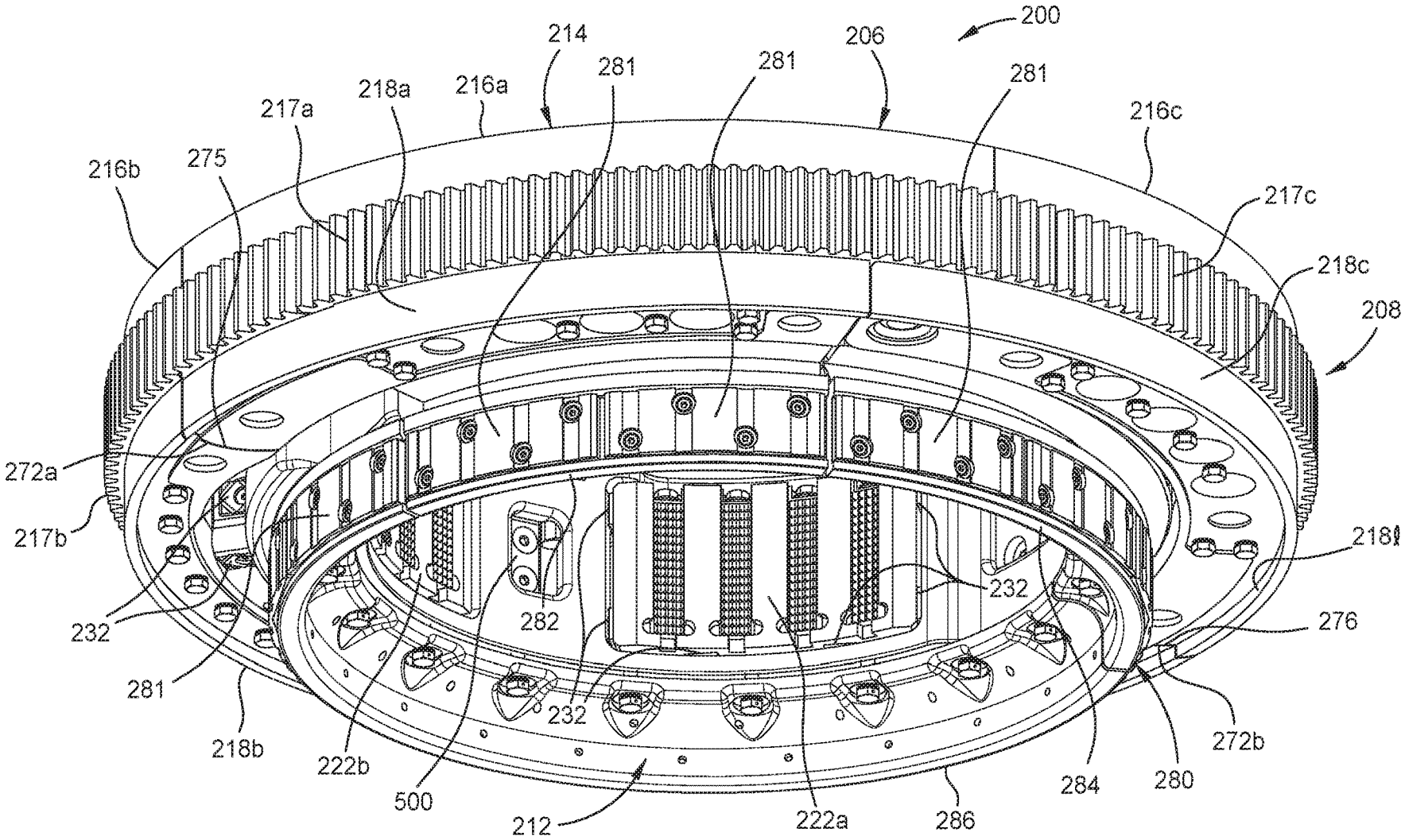
Figure 2D:
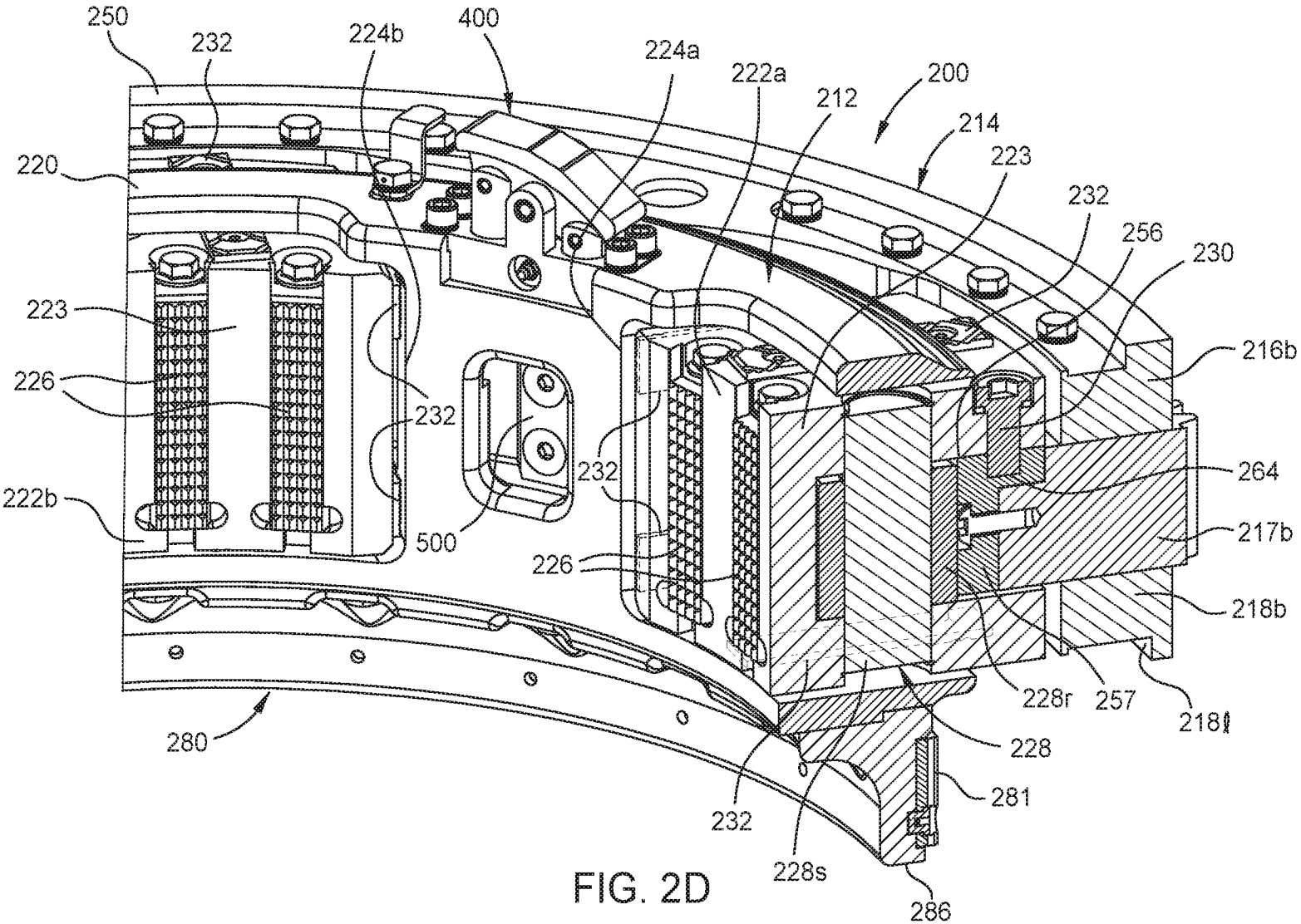

The rotary gripping apparatus 200 has a jaw carrier 212 and a cam body 214. In the embodiment illustrated in FIGS. 2A-2D, the jaw carrier 212 has an active jaw portion 220, a passive jaw portion 240, and a brake 280. The active jaw portion 220 is a jaw base of the jaw carrier 212. As shown in FIGS. 2A and 2B, the active jaw portion 220 has two active jaws 222*a,b* disposed in a respective jaw cavity 224*a,b*. FIG. 2D illustrates a cross section of the rotary gripping apparatus 200 to show a cross section of the active jaw 222*b*. The active jaws 222 have a body 223, gripping elements 226, a roller assembly 228, and a follower member 230. As shown in FIG. 2D, the gripping elements 226 are attached to the body 223. In some embodiments, the gripping elements 226 will be integrally formed with the body 223. The roller assembly 228 includes a shaft 228*s* and a roller 228*r*. The roller assembly 228 may be attached to or integral with the body 223. The follower member 230 may be a pin as shown in FIG. 2D. Each active jaw 222*a,b* is radially moveable relative to the jaw carrier 212 in the respective jaw cavity 224*a,b*. Radial movement is defined as movement along a radius of the rotary gripping apparatus 200. One or more slide bearings 232 may be disposed in each jaw cavity 224 to facilitate the radial movement of the active jaws 222 with respect to the jaw carrier 212 and cam body 214. As shown in FIG. 2D, some of the slide bearings 232 are shown as dashed lines.

The passive jaw portion 240 includes a first passive jaw assembly 242*a* and a second passive jaw assembly 242*b*. Each passive jaw assembly 242*a,b* has a passive jaw 244*a,b* having gripping members 246. Unlike the active jaw 222, each passive jaw 244 is not radially movable with respect to the jaw carrier 212. In some embodiments, the gripping members 246 are attached to the passive jaw 244. In other embodiments, the gripping members 246 are formed integrally with the passive jaw 244. In the closed configuration, each passive jaw assembly 242*a,b* interfaces with the active jaw portion 220 such that the jaw carrier 212 forms an enclosed ring. In the open configuration, one or both of the passive jaw assemblies 242*a,b* has been moved with respect to the active jaw portion 220. The first passive jaw assembly 242*a* is a first jaw arm and the second passive jaw assembly 242*b* is a second jaw arm.

The cam body 214 is disposed about the jaw carrier 212. The cam body 214 forms an enclosed ring around the jaw carrier 212 when the rotary gripping apparatus 200 is in the closed configuration. The cam body 214 has a cam base 250, a first cam arm 252, and a second cam arm 254. The first cam arm 252 and the second cam arm 254 are pivotally coupled to the cam base 250, such as by a pivot pin 251. The cam body 214 has gear teeth 217*t* disposed on an outer surface, and the gear teeth 217*t* encircle the cam body 214. The drive gear (not shown) of the power tong 110 may engage the gear teeth 217*t* to rotate the rotary gripping apparatus 200. The drive gear is driven by the motor unit 130. In some embodiments, the motor unit 130 includes the drive gear.

In some embodiments, gear teeth 217*t* are formed on or attached to the gear member 217 of the cam body 214. The gear member 217 may be disposed between a first body member 216 and a second body member 218 as shown in FIGS. 2A-2D. The first body member 216 and the second body member 218 may be attached to the gear member 217 using suitable fasteners, such as bolts, screws, and/or by welds. The first body member 216 is made of three segments: a first arm segment 216*a*, a base segment 216*b*, and a second arm segment 216*c*. The gear member 217 is made up of three segments: a first arm segment 217*a*, a base segment 217*b*, and a second arm segment 217*c*. As shown in FIG. 2C, the second body member 218 is made of three segments: a first arm segment 218*a*, a base segment 218*b*, and a second arm segment 218*c*. The first cam arm 252 includes the first arm segment 216*a*, the first arm segment 217*a*, and the first arm segment 218*a*. The second cam arm 254 includes the second arm segment 216*c*, the second arm segment 217*c*, and the second arm segment 218*c*. The cam base 250 includes the base segment 216*b*, the base segment 217*b*, and the base segment 218*b*. The pivot pin 251 for the first cam arm 252 is disposed in a bore through the first arm segment 216*a*, the base segment 217*b*, and the first arm segment 218*a*. The pivot pin 251 of the second cam arm 254 is disposed in a bore formed through the second arm segment 216*c*, the base segment 217*b*, and the second arm segment 218*c*.

Figure 7A:
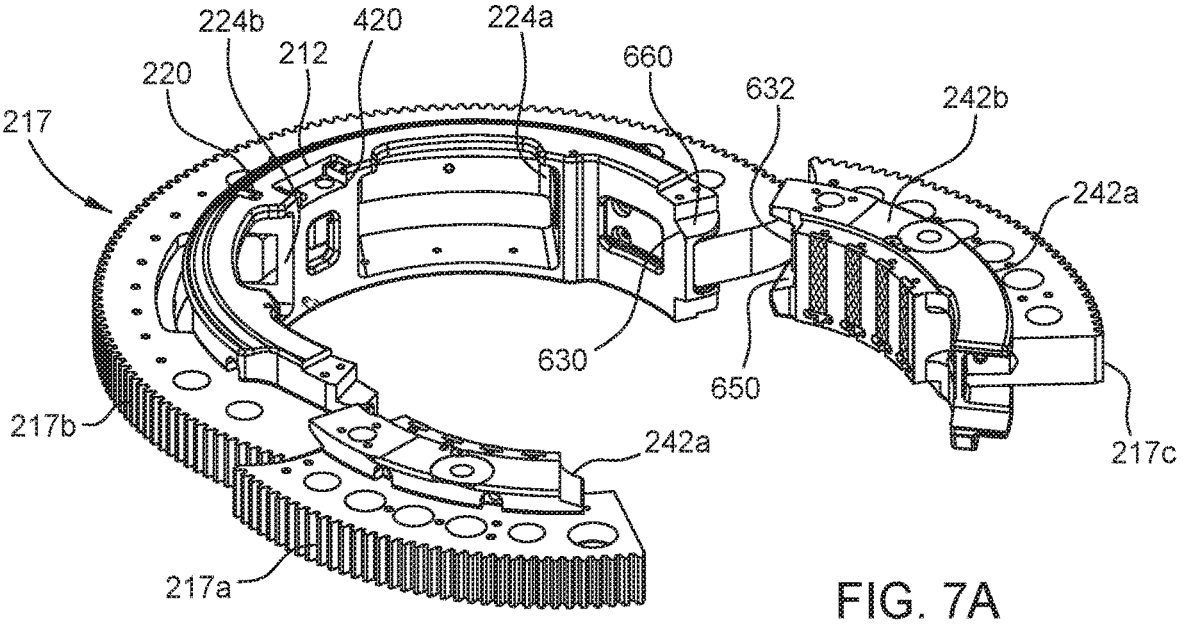
FIGS. 7A-7D and 8A-8C illustrate the rotary gripping apparatus 200 without the first body member 216, the second body member 218, the active jaws 222, the alignment assembly 350, the make/break switch 400, and the stop key 500 to better illustrate the movement of the passive jaw assemblies 242*a,b* relative to the active jaw portion 220 of the jaw carrier 212.
Figure 7B:
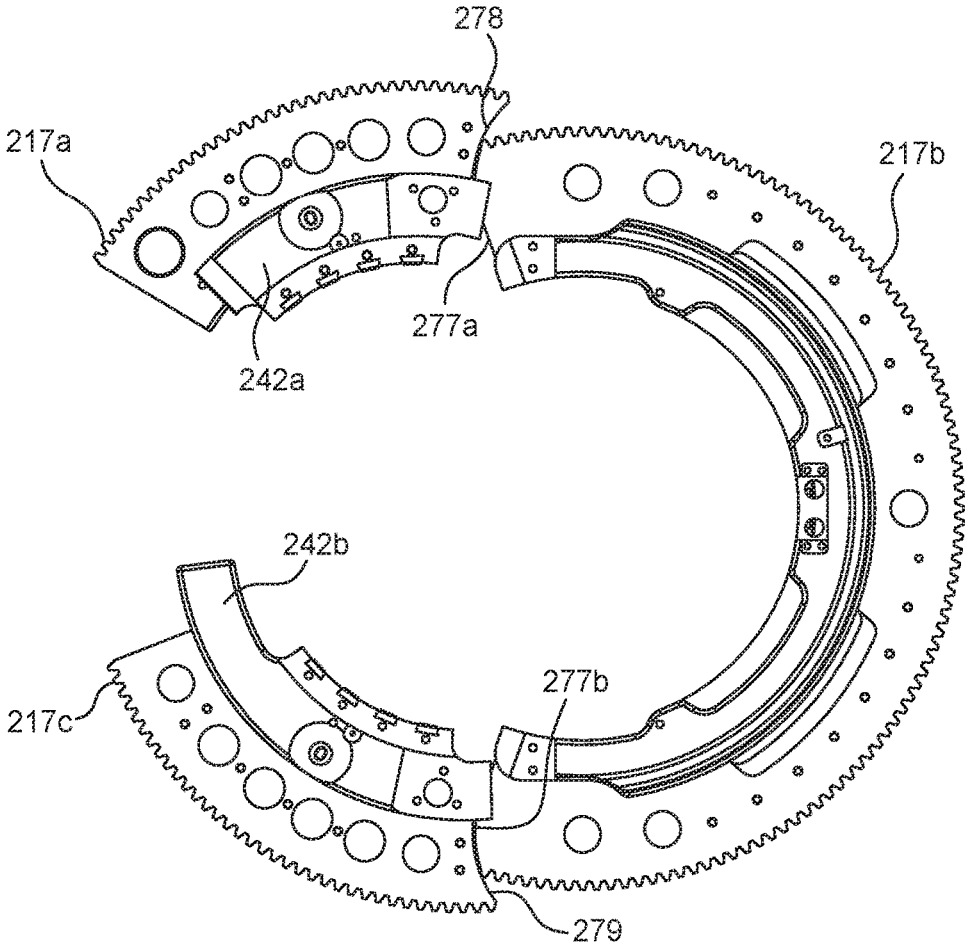

In some embodiments, and as shown in FIG. 2A, the base segment 216*b* has two tapered surfaces 270*a,b* disposed at opposite ends of the base segment 216*b*. In some embodiments, and as shown in FIG. 2C, the base segment 218*b* has two tapered surfaces 272*a,b*. The first arm segment 216*a* has a tapered surface 273 disposed at one end corresponding to the tapered surface 270*a* of the base segment 216*b*. The tapered surfaces 270*a*, 273 are configured to allow the first arm segment 216*a* to move relative to the base segment 216*b*. The second arm segment 216*c* has a tapered surface 274 disposed at one end corresponding to the tapered surface 270*b*. The tapered surfaces 270*b*, 274 are configured to allow the second arm segment 216*c* to move relative to the base segment 216*b*. As shown in FIG. 2C, the first arm segment 218*a* has a tapered surface 275 disposed at one end corresponding to the tapered surface 272*a* of the base segment 218*b*. The tapered surfaces 272*a*, 275 are configured to allow the first arm segment 218*a* to move relative to the base segment 218*b*. As shown in FIG. 2C, the second arm segment 218*c* has a tapered surface 276 disposed at one end corresponding to the tapered surface 272*b*. The tapered surfaces 272*b*, 276 are configured to allow the second arm segment 218*c* to move relative to the base segment 218*b*. The base segment 217*b*, as shown in FIG. 7B has two tapered surfaces 277*a,b* disposed at opposite ends. The first arm segment 217*a* of the gear member 217 has a tapered surface 278 disposed at one end corresponding to the tapered surface 277*a*. The tapered surfaces 277*a*, 278 are configured to allow the first arm segment 217*a* move relative to the base segment 217*b*. The second arm segment 217*c* has a tapered surface 279 corresponding to tapered surface 277*b*. The tapered surfaces 277*b*, 279 are configured to allow the second arm segment 217*c* to move relative to the base segment 217*b*.

Figure 3:
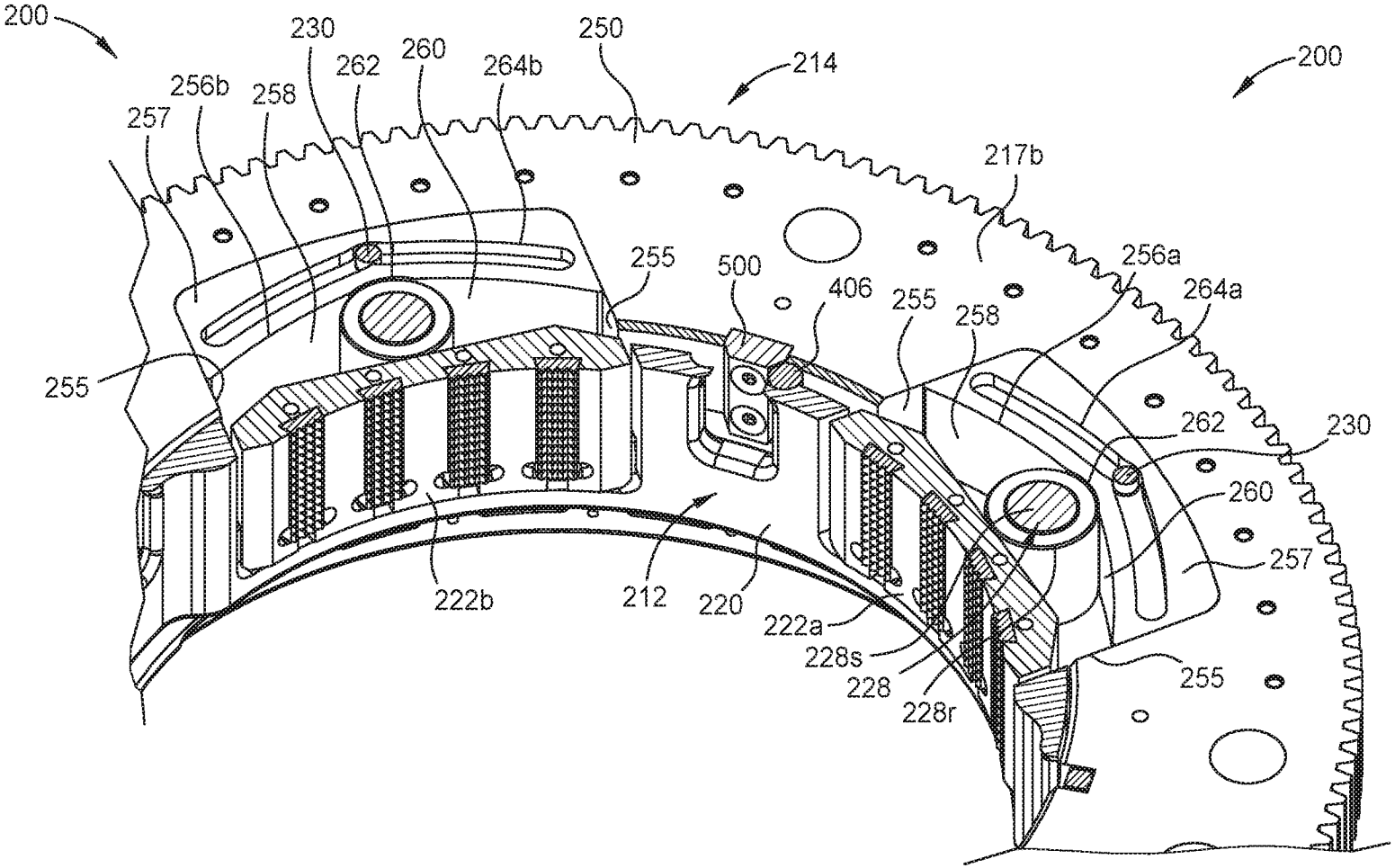
FIG. 3 illustrates a partial cross section of the rotary gripping apparatus 200.

FIG. 3 is a cross-sectional view of one embodiment of the rotary gripping apparatus 200. As shown, the cam base 250 has a two cams 256*a,b*. Each cam 256 corresponds to an active jaw 222. In the illustrated embodiment, cam 256*a* corresponds to active jaw 222*a* and cam 256*b* corresponds to active jaw 222*b*. Each cam 256 has a first cam face 258, a second cam face 260, and a third cam face 262. The third cam face 262 is disposed between the first cam face 258 and the second cam face 260. In some embodiments, the third cam face 262 is a recess and the first cam face 258 and the second cam face 260 are inclined relative to the third cam face 262. The cam body 214 also includes a slot 264, such as slots 264*a,b*, corresponding to each cam 256. The slot 264 is contoured to follow the cam 256. As shown in FIG. 3, the roller 228*r* of the active jaw 222 is engaged with the third cam face 262. However, the roller 228*r* may roll along the first cam face 258 and/or the second cam face 260. The follower member 230 is partially disposed in the slot 264. As shown in FIG. 2D, the cam 256 and slot 264 may be part of an attachment 257 that is secured, for example, to the gear member 217 via bolts, screws, and/or welds. However, each cam 256 and/or each slot 264 may be integrally formed with the cam body 214.

When the rotary gripping apparatus 200 is in the closed configuration, the cam body 214 is rotatable relative to the jaw carrier 212 in one direction to extend the active jaws 222*a,b* from a radially retracted position to a radially extended position. For example, as the cam body 214 is rotated in a clockwise direction relative to the jaw carrier 212, the roller assembly 228 moves along the inclined first cam face 258, thereby moving the active jaw 222 to the radially extended position. The follower member 230 also moves in the slot 264 as the active jaw 222 moves from the radially retracted position to the radially extended position. The active jaws 222*a,b* can be moved from the radially extended position to the radially retracted position by the rotation of the cam body 214 with respect to the jaw carrier 212 in the opposite direction, which moves the roller assembly 228 down the inclined first cam face 258 and the follower member 230 back along the slot 264 to cause the radial retraction of the active jaw 222. Thus, the cam 256 causes the radial extension of the active jaw 222 when the cam body 214 is rotated in one direction, and the follower member 230 causes the radial retraction of the active jaw 222 as the follower member 230 moves in the slot 264 when the cam body 214 is rotated in the opposite direction. In some embodiments, the engagement of the follower member 230 with the slot 264 connects the active jaw 222 to the jaw carrier 212 such that the active jaw 222 does not fall out of the jaw carrier 212.

For example, the first cam face 258 is configured to move an active jaw 222 from the radially retracted position to the radially extended position when the cam body 214 rotates relative to the jaw carrier 212 in a clockwise direction. The cam body 214 may rotate in the clockwise direction during a make-up operation. The roller assembly 228 moves along the first cam face 258 as the active jaw 222 extends. In order to move the active jaw 222 from the radially extended position to the radially retracted position, the cam body 214 rotates in a counter-clockwise direction and the follower member 230 follows the slot 264 to retract the active jaw 222 as the roller assembly 228 moves along the first cam face 258. In another example, the second cam face 260 is configured to move the active jaw 222 from the retracted position to the extended position when the cam body 214 rotates relative to the jaw carrier 212 in a counter-clockwise direction. The cam body 214 may rotate in the counter-clockwise direction during a break-out operation. The roller assembly 228 moves along the second cam face 260 as the active jaw 222 extends. In order to move the active jaw 222 from the radially extended position to the radially retracted position, the cam body 214 rotates in a clockwise direction relative to the jaw carrier 212 and the follower member 230 follows the slot 264 to retract the active jaw 222 as the roller assembly 228 moves along the second cam face 260. When the active jaws 222 are in a retracted position, as shown in FIG. 3, the roller assembly 228 is engaged with the third cam face 262.

In some embodiments, the active jaws 222 have a biasing member, such as a spring, configured to retract the active jaw 222 instead of the follower member 230 in the slot 264. The biasing member biases the active jaw 222 toward the retracted position. The biasing member is disposed in the jaw cavity 224. One end of the biasing member is coupled to the active jaw 222 and other end is coupled to the jaw carrier 212. For example, when the cam body 214 rotates relative to the jaw carrier 212 in a direction to radially extend the active jaws 222, the biasing member is stretched. When the cam body 214 rotates relative to the jaw carrier 212 in an opposite direction, the biasing member contracts and pulls the active jaw 222 back to the radially retracted position. In some embodiments including the biasing member to retract the active jaws 222, the rotary gripping apparatus 200 includes the follower member 230 that is partially disposed in a slot, such as slot 264.

When the active jaws 222 are moved from the radially retracted position to the radially extended position, the extension of the active jaws 222 is limited by either the outer diameter of the tubular being gripped and/or the distance that the roller assembly 228 can travel along the cam 256, such as along the first cam face 258 or the second cam face 260. Once the active jaw 222 is prevented from further extension, the jaw carrier 212 and cam body 214 become rotationally locked. This allows the drive gear of the power tong 110 to rotate the entire rotary gripping apparatus 200 to make-up or break-out the tubular gripped by the active jaws 222 and the passive jaws 244. For example, the extension of the active jaw 222 may be limited by the engagement of the roller assembly 228 with one of the walls 255 adjacent the cam 256. Once the roller assembly 228 engages with the wall 255, then the cam body 214 is prevented from continued rotation relative to the jaw carrier 212. As a result, the cam body 214 and the jaw carrier 212 are rotationally locked. When the cam body 214 and jaw carrier 212 are rotationally locked, the tubular gripped by the active jaws 222 and passive jaws 244 can be rotated by the rotation of the rotary gripping apparatus 200.

When the rotary gripping apparatus 200 is in the closed configuration, the cam body 214 is rotatable relative to the jaw carrier 212 to facilitate the engagement of the jaws 222, 244 with a tubular for a make-up or break-out operation. When it is desired to introduce another tubular into the rotary gripping apparatus 200, at least one of the first rotary arm 206 and second rotary arm 208 move relative to the rotary base 204 from the closed position to the open position to form the gap 210. When the rotary gripping apparatus 200 is converted from the closed configuration to the open configuration to form the gap 210, the first passive jaw assembly 242*a* and first cam arm 252 are attached together by a lock 300*a* to form the first rotary arm 206, and the second passive jaw assembly 242*b* and the second cam arm 254 are attached together with a lock 300*b* to form the second rotary arm 208. The locks 300*a,b* prevent the respective passive jaw assembly 242 from falling off the respective cam arm 252, 254 when the rotary gripping apparatus 200 is in the open configuration. After a new tubular has cleared the gap 210, the rotary gripping apparatus 200 may be converted back to the closed configuration, and the lock 300*a* unlocks to release the first passive jaw assembly 242*a* from the first cam arm 252 and the lock 300*b* unlocks to release the second passive jaw assembly 242*b* from the second cam arm 254. The rotary gripping apparatus 200 may be converted to the open configuration to remove the tubular disposed in the rotary gripping apparatus 200.

As shown in FIG. 2A, the active jaws 222 are disposed directly across from a corresponding passive jaw 244. Thus, the active jaw 222*a* moves radially toward and away from the passive jaw 244*a*, and the active jaw 222*b* moves radially toward and away from the passive jaw 244*b*. The active jaws 222 move radially between the retracted and extend positons with substantially no lateral movement relative to the radius of the rotary gripping apparatus 200 due to the slide bearings 232 and the rolling engagement of the roller assembly 228 with the cam 256. Lateral movement of the active jaw 222 relative to the radius of the rotary gripping apparatus 200 is mitigated or does not occur at all. Thus, when an active jaw 222 grips a tubular, it imparts no lateral forces, or substantially no lateral forces, to the tubular. Thus, the force applied by the active jaw 222 to the gripped tubular is perpendicular to the tubular. The mitigation of lateral forces applied to the tubular by the active jaw 222 decreases the chance that the active jaw 222 fails to grip the tubular and decreases galling of the tubular.

Figures 4A, 4B:
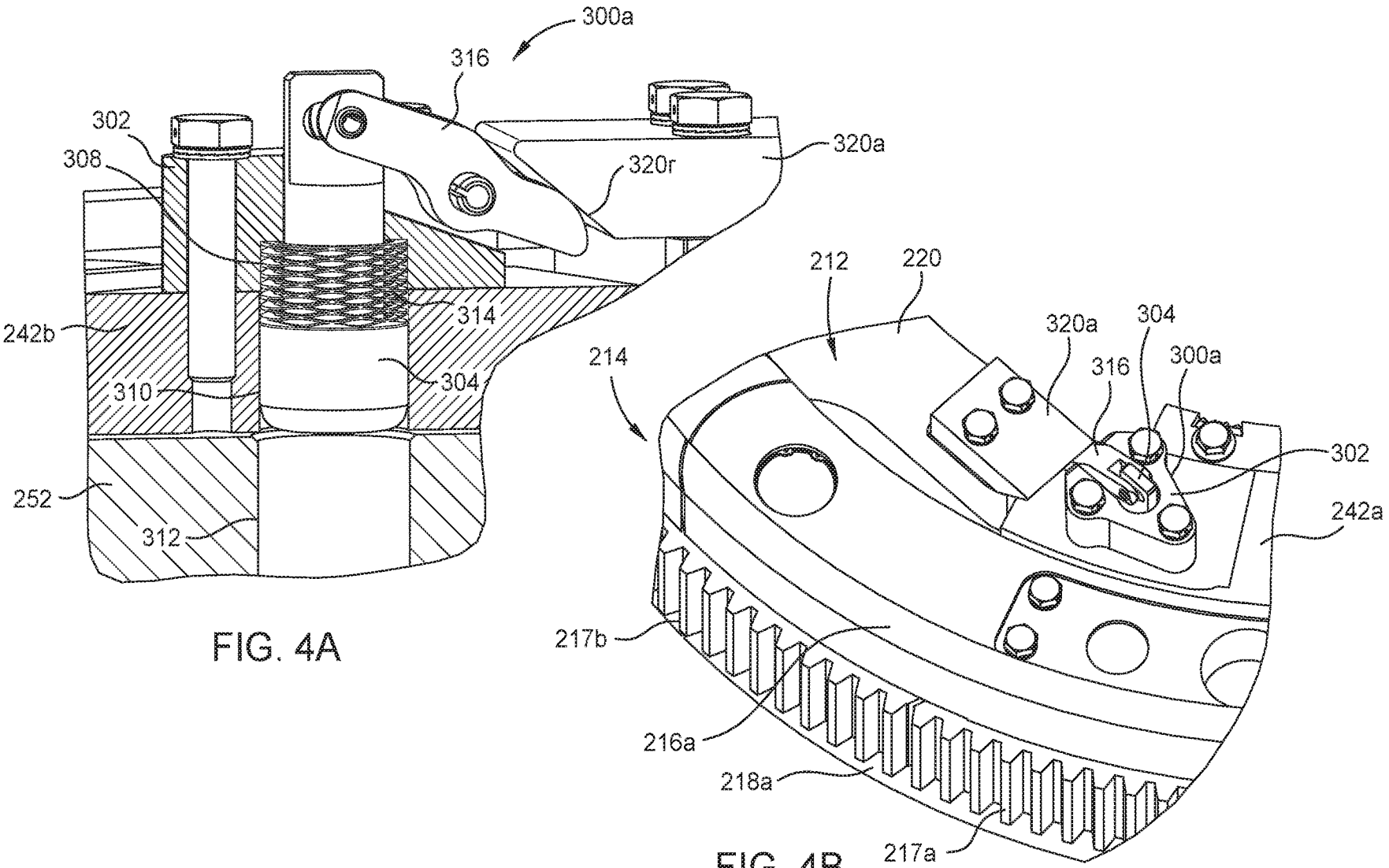
FIGS. 4A and 4B illustrate a lock 300 and a release member 320.

FIGS. 4A and 4B illustrate one embodiment of the lock 300. As shown, the lock 300 may be coupled to the passive jaw assembly 242, such as the first passive jaw assembly 242*a*. The lock 300 includes a housing 302, a locking member 304, a biasing member 314, and a lever member 316. FIGS. 4A-4B illustrate lock 300*a*, but lock 300*b* may have the same structure and principle of operation. In the illustrated embodiment in FIG. 2A-2B, the locks 300*a,b* are identical. The housing 302 may be attached to the passive jaw assembly 242, via a bolt, screw, and/or weld connection. The locking member 304 is at least partially disposed in a bore 308 of the housing 302. In an unlocked configuration, as shown in FIG. 4A, the locking member 304 may also be partially disposed in a bore 310 of the passive jaw assembly 242. The first and second cam arms 252, 254 have a recess 312. In a locked configuration, the locking member 304 has been displaced such that locking member 304 is partially disposed in the recess 312. In some embodiments, the recess 312 is a bore. The biasing member 314 is disposed about a portion of the locking member 304 and biases the lock 300 towards the locked configuration. When the locks 300*a,b* are in the locked configuration, the locks 300*a,b* attach the respective first and second passive jaw assemblies 242*a,b* with the respective first or second cam arms 252, 254.

When the rotary gripping apparatus 200 is in the closed configuration, the lock 300 is maintained in the unlocked configuration by the engagement of the lever member 316 with a release member 320 coupled to the active jaw portion 220. FIGS. 2A and 2B illustrate the jaw carrier 212 having two release members 320*a,b*. The release member 320*a* is illustrated in FIG. 4A. The lever member 316 may be pivotally coupled to the housing 302 and the locking member 304. The lever member 316 is engaged with the release member 320 when the rotary gripping apparatus 200 is in the closed configuration, and the biasing force of the biasing member 314 is overcome such that the locking member 304 is not disposed in the recess 312. As the rotary gripping apparatus 200 opens, the lever member 316 slides along a ramp surface 320*r* of the release member 320, and the biasing member 314 moves the locking member 304 into the recess 312 such that the lock 300 is in the locked configuration. In some embodiments, the lever member 316 is completely disengaged with the release member 320 before the biasing member 314 moves the locking member 304 into the recess 312 such that the lock 300 is in the locked configuration.

As shown in FIG. 2A, each lock 300*a,b* has a corresponding release member 320*a,b*. In some embodiments, the lock 300 is a pin lock, or some other suitable lock to selectively attach, for example, the first passive jaw assembly 242*a* to the first cam arm 252. In some embodiments, it is contemplated that lock the 300*a* will be different than the lock 300*b*, and vice versa.

Figure 5:
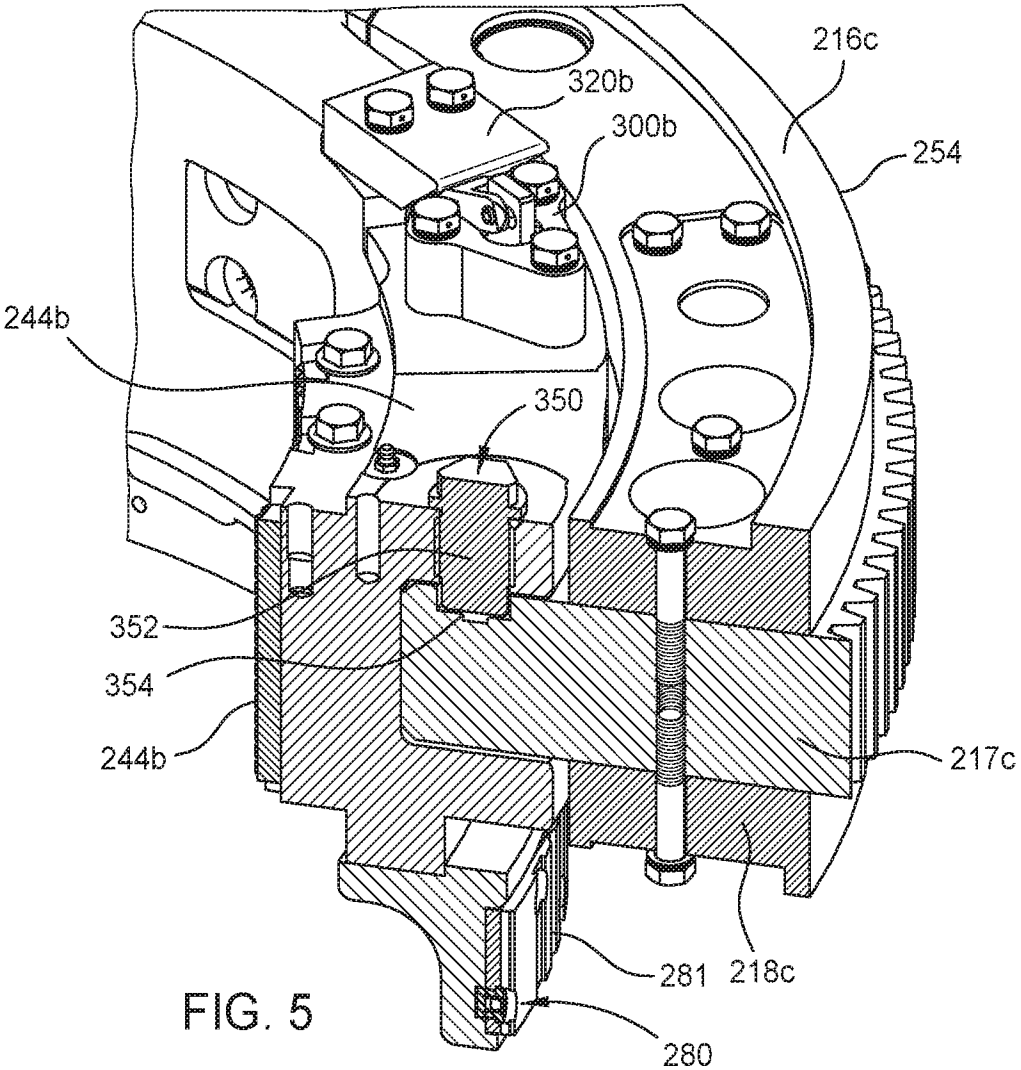
FIG. 5 is a cross-sectional view of FIG. 2B and illustrates an arm alignment assembly 350.

In some embodiments, each passive jaw assembly 242 has an arm alignment assembly 350 as shown in FIG. 5. FIG. 5 is a cross sectional view of the rotary gripping apparatus 200. The arm alignment assembly 350 has an alignment member 352 disposed in a slot 354 formed in the respective first and second cam arms 252, 254. In this embodiment, the slot 354 may be formed in the gear member 217. For example, the first arm segment 217*a* and the second arm segment 217*c* each have a slot 354. In some embodiments, the alignment member 352 is a bolt attached to the passive jaw assembly 242. In some embodiments, the alignment member 352 includes a spring biasing a ball into engagement with the slot 354. In some embodiments, the slot 354 has a length corresponding to the maximum amount of rotation of the cam body 214 can rotate relative to the jaw carrier 212. The slot 354 and the alignment member 352 interact to guide relative rotational movement between the cam body 214 and the jaw carrier 212. For example, the alignment assembly 350 of the first passive jaw assembly 242*a* keeps the first passive jaw assembly 242*a* aligned with the first cam arm 252, and the alignment assembly 350 of the second passive jaw assembly 242*b* keeps the second passive jaw assembly 242*b* aligned with the second cam arm 254.

When the alignment assembly 350 is used in conjunction with a lock 300, the alignment assembly 350 prevents the passive jaw assemblies 242*a,b* from pivoting with respect to its respective cam arms 252, 254 about the respective locks 300*a,b* when the locks 300*a,b* are in the locked configuration. Thus, the lock 300 and the alignment assembly 350 provide two points of restraint against relative movement of the passive jaw assemblies 242*a,b* with respect to the corresponding cam arms 252, 254 after the rotary gripping apparatus 200 is opened.

Referring back to FIG. 2A, the rotary gripping apparatus 200 has a bore 236 formed through the first cam arm 252 and the second cam arm 254. When the rotary gripping apparatus 200 is in the closed configuration, a pin or other suitable fastener (not shown) may be inserted into the bore 236 to lock the first cam arm 252 to the second cam arm 254. The pin or other suitable fastener will be removed from the bore 236 prior to opening the rotary gripping apparatus 200.

Figure 6B:
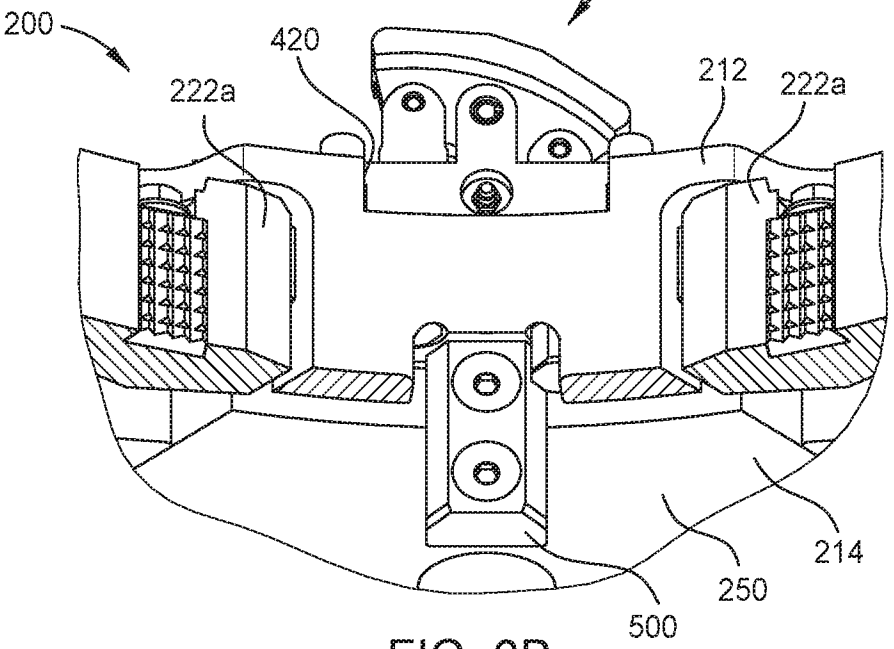
FIG. 6B is a partial cross-sectional view of the rotary gripping apparatus 200 and illustrates the make/break switch 400 in the first configuration and a stop key 500.
Figure 6A:
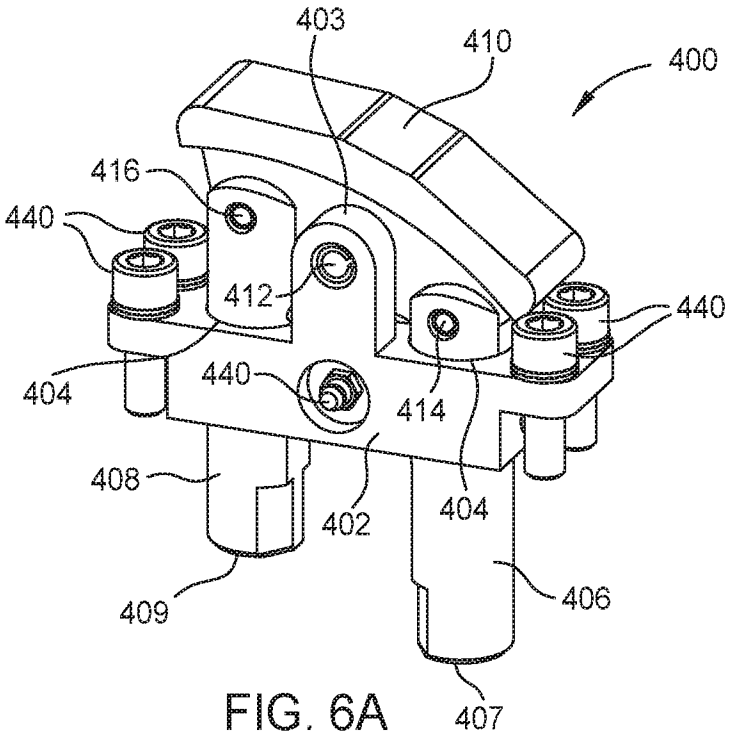
FIG. 6A illustrates a make/break switch 400 in a first configuration.
Figure 6C:
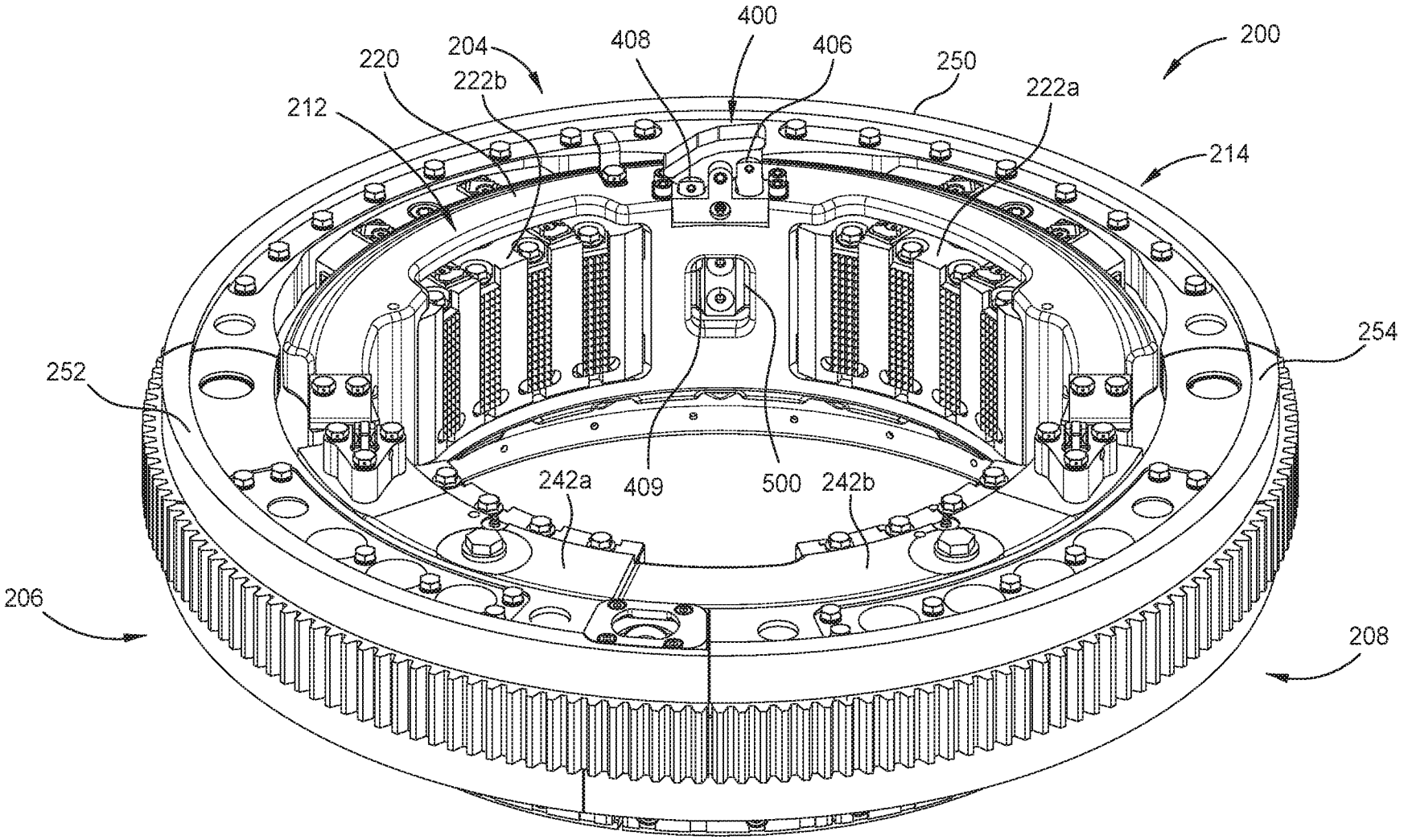
FIG. 6C illustrates the rotary gripping apparatus 200 with the make/break switch 400 in a second configuration.

FIGS. 6A-C illustrate an exemplary embodiment of a make/break switch 400. The make/break switch 400 has a body 402, a first stop member 406, a second stop member 408, and a switch member 410. The body 402 has a bore 404 for both the first stop member 406 and the second stop member 408. The switch member 410 is pivotally coupled to the body 402 at pivot point 412, such as by a pin or bolt attachment. The switch member 410 is attached to the first stop member 406 by a first pivotable attachment 414, such as by a screw or bolt. The switch member 410 is attached to the second stop member 408 by a second pivotable attachment 416, such as by a screw or bolt. The make/break switch 400 may be attached to the jaw carrier 212 (as shown in FIG. 2A) via a plurality of fasteners 440. As shown in FIG. 6B, the make/break switch 400 may be at least partially disposed in a make/break switch recess 420 of the jaw carrier 212. As shown, the make/beak switch recess 420 is formed in the active jaw portion 220. In some embodiments, the first stop member 406 and the second stop member 408 is at least partially disposed in a corresponding bore formed in the jaw carrier 212.

Figure 9:
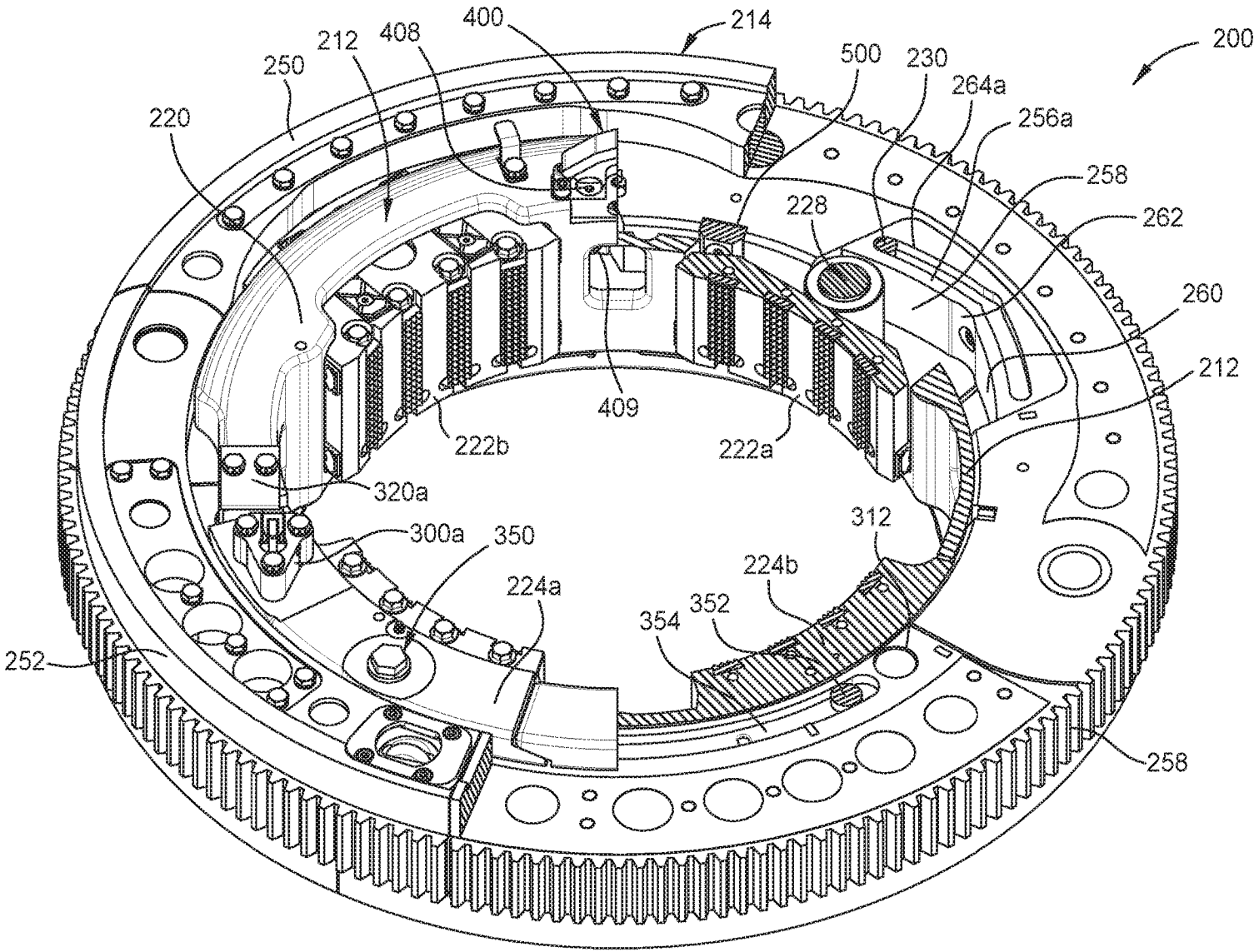
FIG. 9 is a partial cross-sectional view of the rotary griping apparatus 200 illustrating the active jaws 222*a,b* in a radially extended position.

The make/break switch 400 has two configurations. The first configuration is shown in FIGS. 6A, 6B and the second configuration is shown in FIG. 6C, 9. In the first configuration, the switch member 410 is tilted toward the first stop member 406. The end 407 of the first stop member 406 is disposed below the end 409 of the second stop member 408. In the second configuration, the switch member 410 is tilted toward the second stop member 408. The end 409 of the second stop member 408 is disposed below the end 407 of the first stop member 406. The make/break switch 400 is movable between the first configuration and the second configuration, and vice versa. In some embodiments, the switch member 410 is engaged with a surface 403 of the body 402. The make/break switch 400 can be moved between configurations manually, or in response to a pneumatic, hydraulic, or electrical actuator.

FIG. 6B illustrates a stop key 500 attached to the cam body 214. In this embodiment, the stop key 500 is attached to the cam base 250. The stop key 500 can be attached to the cam body 214 by a fastener, or the stop key 500 can be an integral component of the cam body 214, such as an integral component of the cam base 250. The stop key 500 is configured to be engaged by the first stop member 406 when the make/break switch 400 is in the first configuration or the second stop member 408 when the make/break switch 400 is in the second configuration. For example, the stop key 500 may be disposed at an equidistant location between cams 256*a,b*, such as an equidistant location between the respective third cam faces 262 of cams 256*a,b*.

When the make/break switch 400 is in the first configuration, the cam body 214 is prevented from rotating relative to the jaw carrier 212 in the clockwise direction to radially extend the active jaws 222 because the stop key 500 will engage the first stop member 406. However, the cam body 214 is rotatable in the counter-clockwise direction relative to the jaw carrier 212 to radially extend the active jaws 222. When the make/break switch 400 is in the second configuration, the cam body 214 is prevented from rotating relative to the jaw carrier 212 in the counter-clockwise direction to radially extend the active jaws 222 because the stop key 500 will engage the second stop member 408. However, the cam body 214 is rotatable in the clockwise direction relative to the jaw carrier 212 to radially extend the active jaws 222. Thus, the make/break switch 400 and stop key 500 controls which direction the cam body 214 can rotate relative to the jaw carrier 212 to extend the active jaws 222.

The make/break switch 400 and stop key 500 limit the amount of rotation of the cam body 214 relative to the jaw carrier 212 when the cam body 214 is rotated to retract the active jaws 222. When the make/break switch 400 is in the first configuration, the stop key 500 will limit the amount of clockwise rotation of the cam body 214 relative to the jaw carrier 212 when retracting the active jaws 222 from the radially extended position. After the stop key 500 engages the first stop member 406, the rotary gripping apparatus 200 is in a neutral alignment, and the rotary gripping apparatus 200 can be opened. When the make/break switch 400 is in the second configuration, the stop key 500 will limit the amount of counter-clockwise rotation of the cam body 214 relative to the jaw carrier 212 when retracting the active jaws 222 from the radially extended position. After the stop key 500 engages the second stop member 408, then the rotary gripping apparatus 200 is in a neutral alignment and the rotary gripping apparatus 200 can be opened.

To open or close the rotary gripping apparatus 200, the jaw carrier 212 and cam body 214 should be in the neutral alignment shown in FIG. 2A. In this embodiment, when in the neutral alignment, the active jaw portion 220 of the jaw carrier 212 is aligned with cam base 250. As shown in FIG. 2A, when in the neutral alignment, the first passive jaw assembly 242*a* is aligned with the first cam arm 252 such that the bore 310 of the first passive jaw assembly 242*a* is aligned with the recess 312 of the first cam arm 252. The alignment of the bore 310 with the recess 312 facilitates the locking member 304 of the lock 300*a* moving into the recess 312 when the first cam arm 252 and first passive jaw assembly 242*a* (e.g. the first rotary arm 206) move from the closed position to the open position. Similarly, when in the neutral alignment, the second passive jaw assembly 242*b* is aligned with the second cam arm 254 such that the bore 310 of the second passive jaw assembly 242*b* is aligned with the recess 312 of the second cam arm 254. The alignment of the bore 310 with the recess 312 facilitates the locking member 304 of the lock 300*b* moving into the recess 312 when the second cam arm 254 and second passive jaw assembly 242*b* (e.g. the second rotary arm 208) moves from the closed position to the open position. If the rotary gripping apparatus 200 is not in the neutral alignment, then the jaw carrier 212 and cam body 214 will be misaligned, which prevents the rotary gripping apparatus 200 from converting from the closed configuration to the open configuration.

Figure 7C:
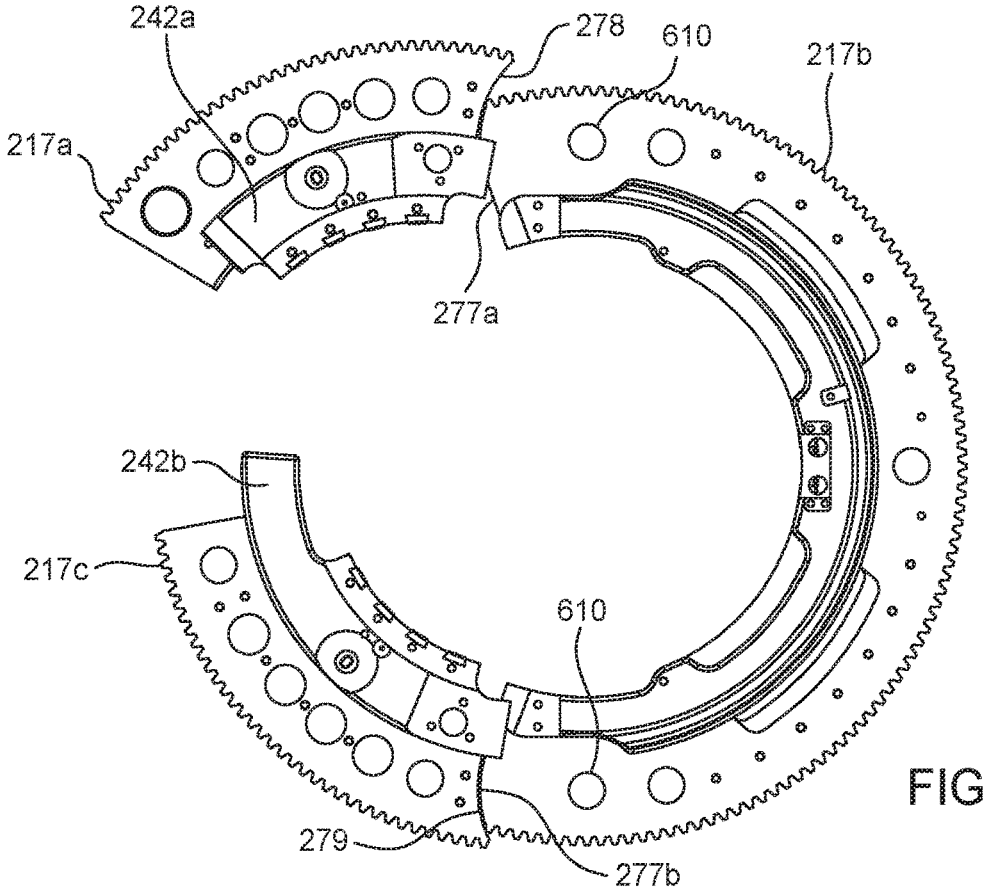
Figure 7D:
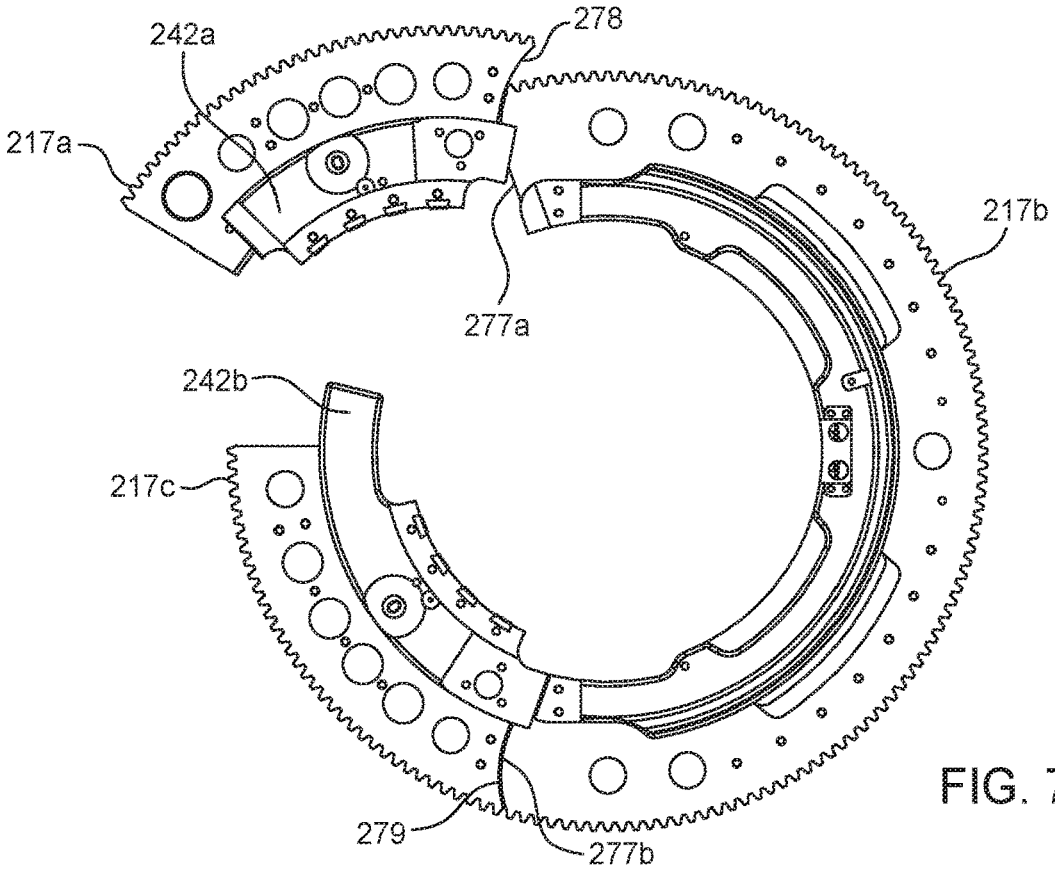

FIGS. 7A-7D and 8A-8C illustrate the rotary gripping apparatus 200 without the first body member 216, the second body member 218, the active jaws 222, the alignment assembly 350, the make/break switch 400, and the stop key 500 to better illustrate the movement of the passive jaw assemblies 242*a,b* relative to the active jaw portion 220 of the jaw carrier 212. FIG. 7B is a top view of FIG. 7A and shows the position of the first arm segment 217*a* and the second arm segment 217*c* when the rotary gripping apparatus 200 is in an open configuration having both the first and second rotary arms 206, 208 in the open position. FIG. 7C shows the position of first arm segment 217*a* in the open position and the position of the second arm segment 217*c* in an intermediate position between the closed and open positions. FIG. 7C also shows the bores 610 in the base segment 217*b* that the pivot pins 251 are partially disposed in to allow the first rotary arm 206 and second rotary arm 208 to pivot relative to the rotary base 204. FIG. 7D illustrates the rotary gripping apparatus 200 in the open configuration, showing the position of the first arm segment 217*a* when the first rotary arm 206 is in the open position and the position of the second arm segment 217*c* after the second rotary arm 208 has returned to, or remained in, the closed position.

Figure 8A:
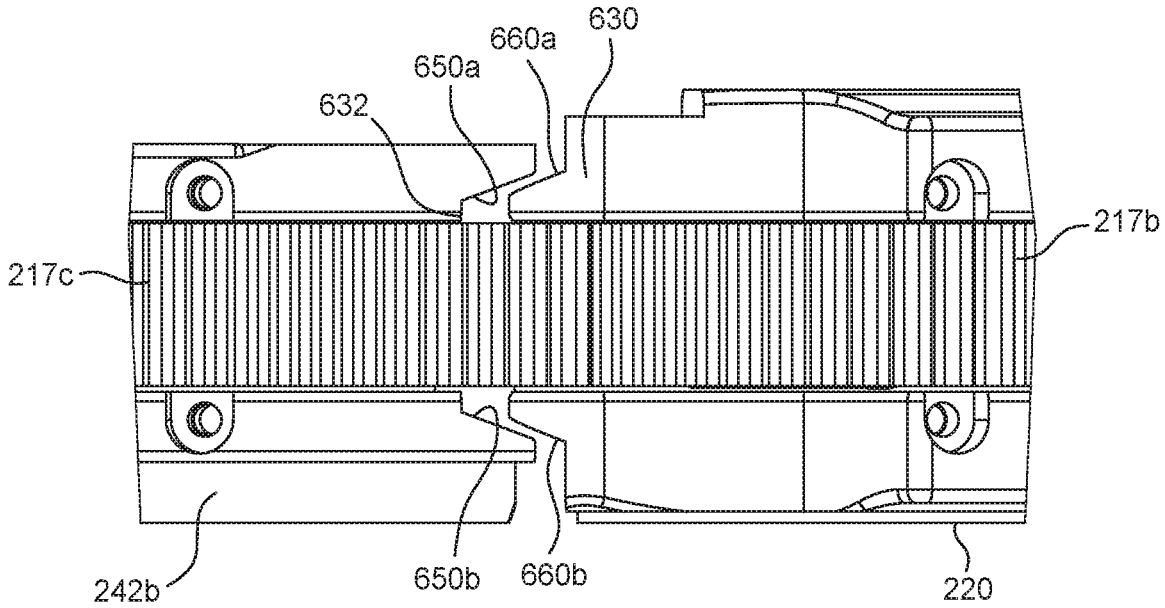
Figure 8B:
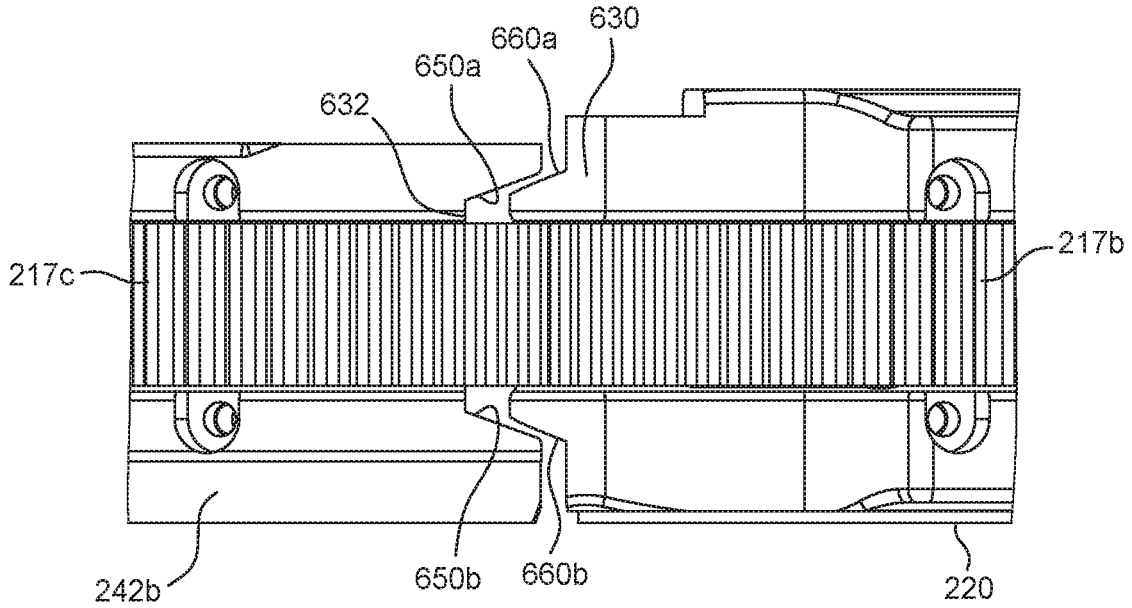
Figure 8C:
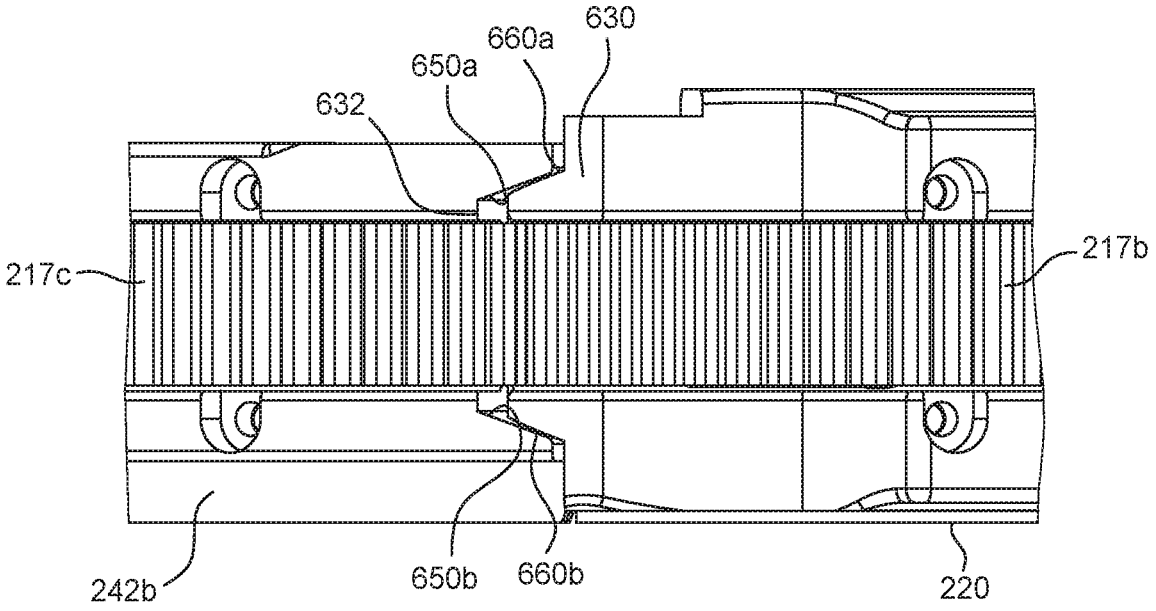

Each passive jaw assembly 242 will have surfaces 650 corresponding to complementary surfaces 660 of the active jaw portion 220 such that the active jaw portion 220 and passive jaw assembly 242 are vertically aligned and engaged when in the closed configuration or when either rotary arm 206, 208 is in the closed position. The surfaces 650 of the passive jaw assembly 242 may be part of a recess 632 configured to receive a protrusion 630 of the active jaw portion 220. The surfaces 660 of the active jaw portion 220 may be disposed on the protrusion 630. FIGS. 8A-8C illustrate the surfaces 650 of the second passive jaw assembly 242*b* corresponding to the complementary surfaces 660 at one end of the active jaw portion 220.

FIG. 8A is a partial side view of FIG. 7B. FIG. 8B is a partial side view of FIG. 7C. FIG. 8C is a partial side view of FIG. 7D. In the illustrated embodiment, the surfaces 650 of the passive jaw assemblies 242*a,b* are an upper surface 650*a* and a lower surface 650*b* of the recess 632. In the illustrated embodiment, the surfaces 660 of the active jaw portion 220 are an upper surface 660*a* and a lower surface 660*b* of the protrusion 630. The upper surface 650*a* is configured to engage the upper surface 660*a*, and the lower surface 650*b* is configured to engage the lower surface 660*b* when the recess 632 receives the protrusion 630 when the respective rotary arm 206, 208 is in the closed position. As shown in FIG. 8A, the surfaces 650*a,b* are disengaged with surfaces 660*a,b* when the second rotary arm 208 is in the open position. As shown in FIG. 8C, the surfaces 650*a,b* are engaged with surfaces 660*a,b* when the second rotary arm 208 is in the closed position. The engagement of the surfaces 650*a,b* with surfaces 660*a,b* vertically aligns the second passive jaw assembly 242*b* with the active jaw portion 220 such that the rotary gripping apparatus 200 can be rotated by the drive gear, including aligning the gear teeth 217*t* of the differing individual segments of the gear member 217.

An exemplary brake 280 of the jaw carrier 212 is illustrated in FIG. 2C. The brake 280 has a plurality of brake pads 281. The brake 280 has a first arm segment 282, a second arm segment 284, and a base segment 286. The base segment 286 is attached to or integral with the active jaw portion 220. The first arm segment 282 is attached to or integral with the first passive jaw assembly 242*a*. The second arm segment 284 is attached to or integral with the second passive jaw assembly 242*b*. When the first cam arm 252 and first passive jaw assembly 242*a* are locked together by the lock 300*a* to form the first rotary arm 206, the first rotary arm 206 will also include the first arm segment 282 of the brake 280. When the second cam arm 254 and the second passive jaw assembly 242*b* are locked together by the lock 300*b* to form the second rotary arm 208, the second rotary arm 208 will also include the second arm segment 284 of the brake 280. When in the neutral alignment, the rotary base 204 includes the base segment 286. When the rotary gripping apparatus 200 is in the closed configuration, the brake 280 forms an enclosed ring that can be engaged with the brake band 142 to slow or stop the rotation of the rotary gripping apparatus 200 and/or to hold the jaw carrier 212 in a fixed position relative to the cam body 214.

For example, to rotate the cam body 214 relative to the jaw carrier 212 to radially extend the active jaws 222*a,b*, the brake band assembly 140 engages the brake 280 to hold the jaw carrier 212 in a fixed position relative to the cam body 214, thereby preventing the jaw carrier 212 from rotating. While the brake band assembly 140 applies a brake force to the brake 280 to hold the jaw carrier 212 in the fixed position, the cam body 214 can rotate relative to the jaw carrier 212 in a first direction to extend the active jaws 222*a,b*. The cam body 214 is rotated relative to the jaw carrier 212 by the drive gear of the power tong 110 until the cam body 214 becomes rotationally locked with the jaw carrier 212. Once the cam body 214 becomes rotationally locked with the jaw carrier 212, the force applied by the drive gear to the cam body 214 is transferred to the jaw carrier 212. When the rotational force applied by the drive gear to the cam body 214 exceeds the break force applied by the brake band 142 to the brake 280, the entire rotary gripping apparatus 200 will be rotated by the drive gear of the power tong 110. The brake band 142 is then disengaged from the brake 280 after rotation has begun, such as by actuating the first and second actuators 144*a,b*. The entire rotary gripping apparatus 200 is rotated to make-up or break-out a tubular gripped by the passive jaws 244 and the active jaws 222. In some embodiments, the brake band assembly 140 can be automated such that the brake band 142 automatically releases the brake 280 upon the full extension of the active jaws 222 to prevent excess wear on the brake pads 281. Automatically releasing the brake 280 may limit the period of contact of the rotating brake 280 with the brake band 142. In some embodiments, the brake band 142 may be re-engaged with the brake 280 during the make-up or break-out operation to control the rotational speed of the rotary gripping apparatus 200.

In another example, the active jaws 222 may be retracted by engaging the brake band assembly 140 with the brake 280 to prevent rotation of the jaw carrier 212 and rotating the cam body 214 relative to the jaw carrier 212 in the opposite direction until the neutral alignment is reached. The brake band assembly 140 can be disengaged from the brake 280 once the neutral alignment is reached.

FIG. 9 illustrates the active jaws 222 in the radially extended position after the cam body 214 has been rotated clockwise relative to the jaw carrier 212. The make/break switch 400 is shown to be in the second configuration. As shown, the roller assembly 228 is engaged with the wall 255 and the first cam face 258. The follower member 230 has moved to one end of the slot 264*b*. The alignment member 352 of the second passive jaw assembly 242*b* is shown disposed in the slot 354 of the second cam arm 254.

Figure 10A:
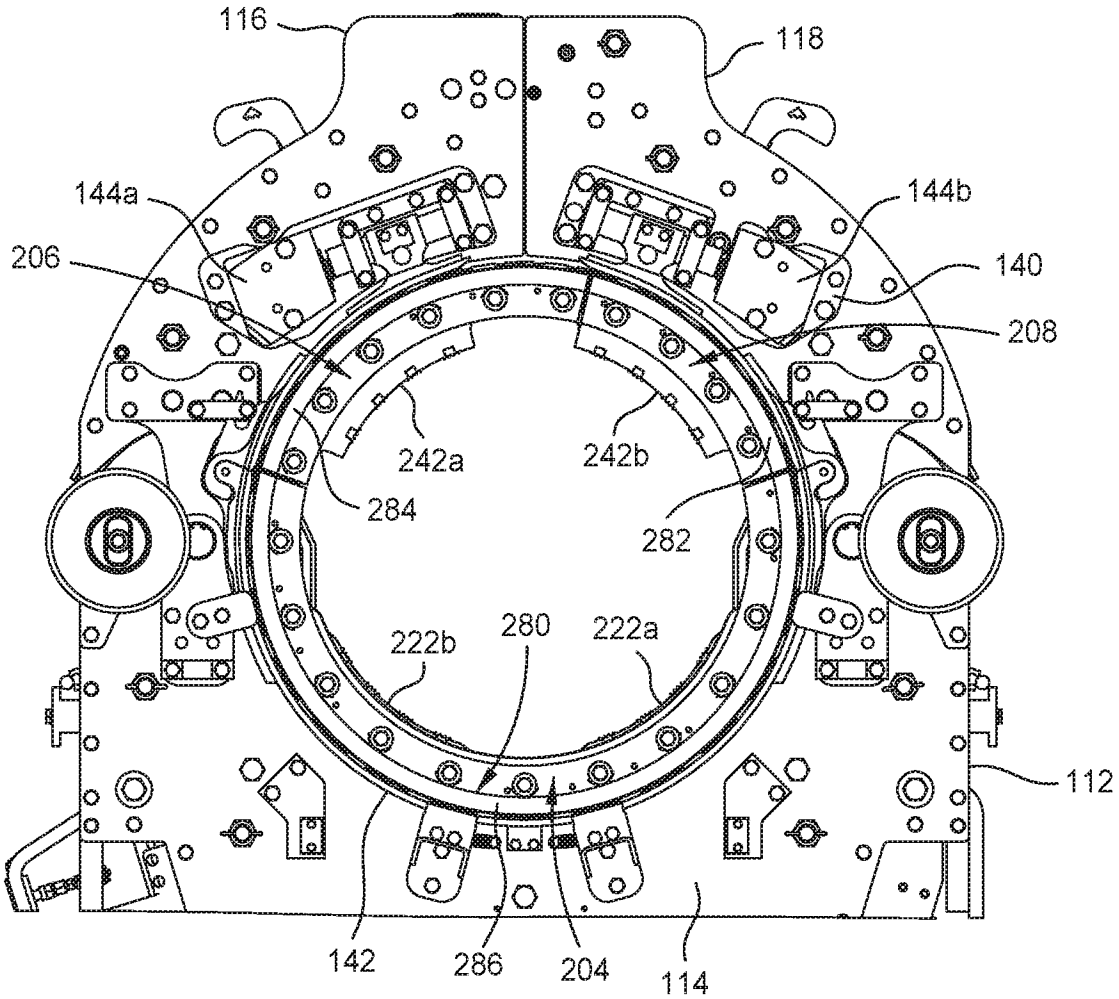
FIG. 10A illustrates an underside of the power tong 110.
Figure 10B:
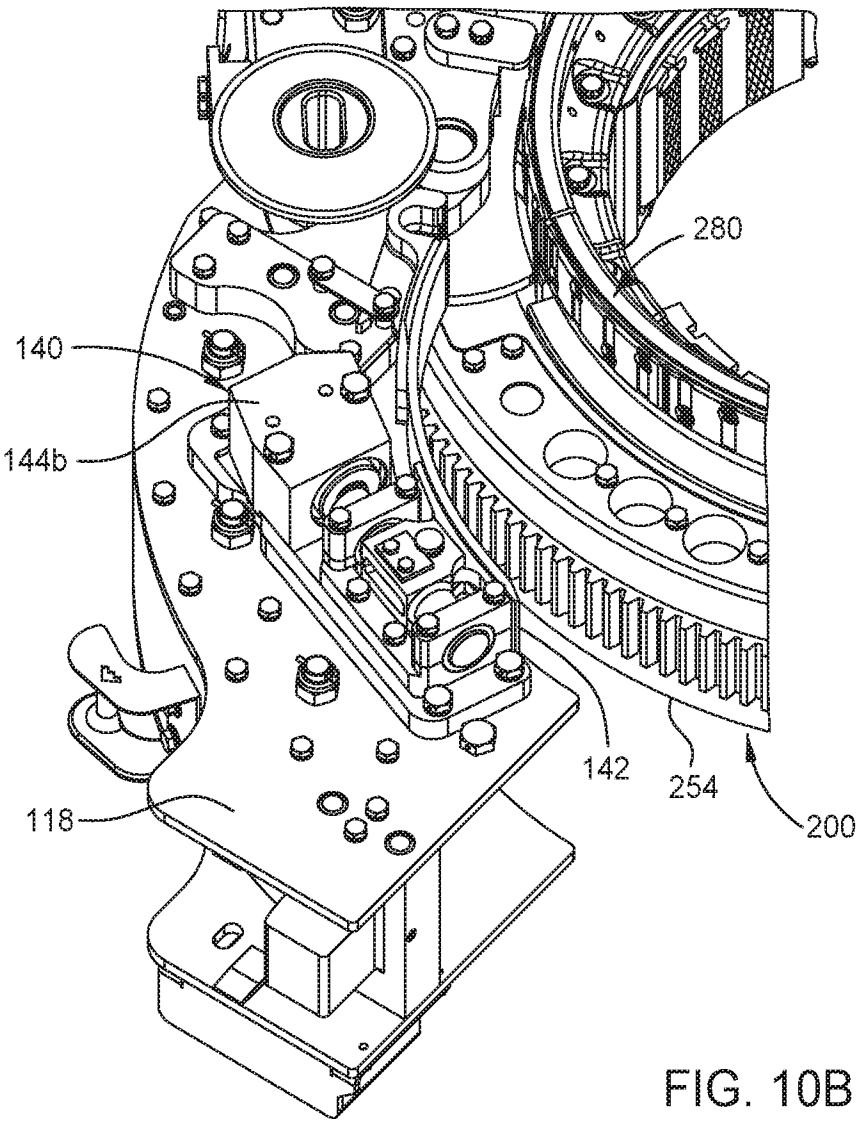
FIG. 10B illustrates a partial view of the power tong 110 showing the second body arm 118 withdrawn away from the rotary gripping apparatus 200.

FIG. 10 illustrates an underside of one embodiment the power tong 110 with the rotary gripping apparatus 200 disposed therein. FIGS. 1 and 10A illustrate the first body arm 116, the second body arm 118, and the brake band assembly 140 of the power tong 110. FIG. 10B illustrates a partial view of the power tong 110 showing the second body arm 118 withdrawn away from the rotary gripping apparatus 200 to better illustrate the body arms of the power tong 110. In some embodiments, the first body arm 116 is configured to selectively grip the first rotary arm 206 and move the first rotary arm 206 between the closed position and the open position. In some embodiments, the second body arm 118 is configured to selectively grip the second rotary arm 208 and move the second rotary arm 208 between the closed positon and the open position. Before the first and second body arms 116, 118 grip the rotary arms 206, 208, the rotary gripping apparatus 200 is placed in the neutral alignment and then rotated to a neutral orientation with respect to the tong body 112 as shown in FIG. 10A. For example, when the rotary gripping apparatus 200 is in the neutral orientation, the first and second body arms 116, 118 are aligned with the respective rotary arms 206, 208. Thus, the first and second body arms 116, 118 can grip and move the respective rotary arms 206, 208 when in the neutral orientation. The first and second body arms 116, 118 are moved by an actuator. When the first and second body arms 116, 118 are not gripping the respective rotary arm 206, 208 of the rotary gripping apparatus 200, the rotary gripping apparatus 200 is rotatable relative to the other components of the power tong 110. In some embodiments, the base body 114 may be configured to selectively grip the rotary base 204 to keep it from moving when the rotary arms 206, 208 are moved. The first and second body arms 116, 118 may selectively grip the respective rotary arms 206, 208 by a plurality of pins attached to the tong body 112 that can be actuated to interface with a plurality of receptacles attached to, or formed within, the respective rotary arms 206, 208. The base body 114 may selectively grip the rotary base 204 by a plurality of pins attached to the tong body 112 that can be actuated to interface with a plurality of receptacles attached to, or formed within, the rotary base 204.

Figures 11A, 11B:
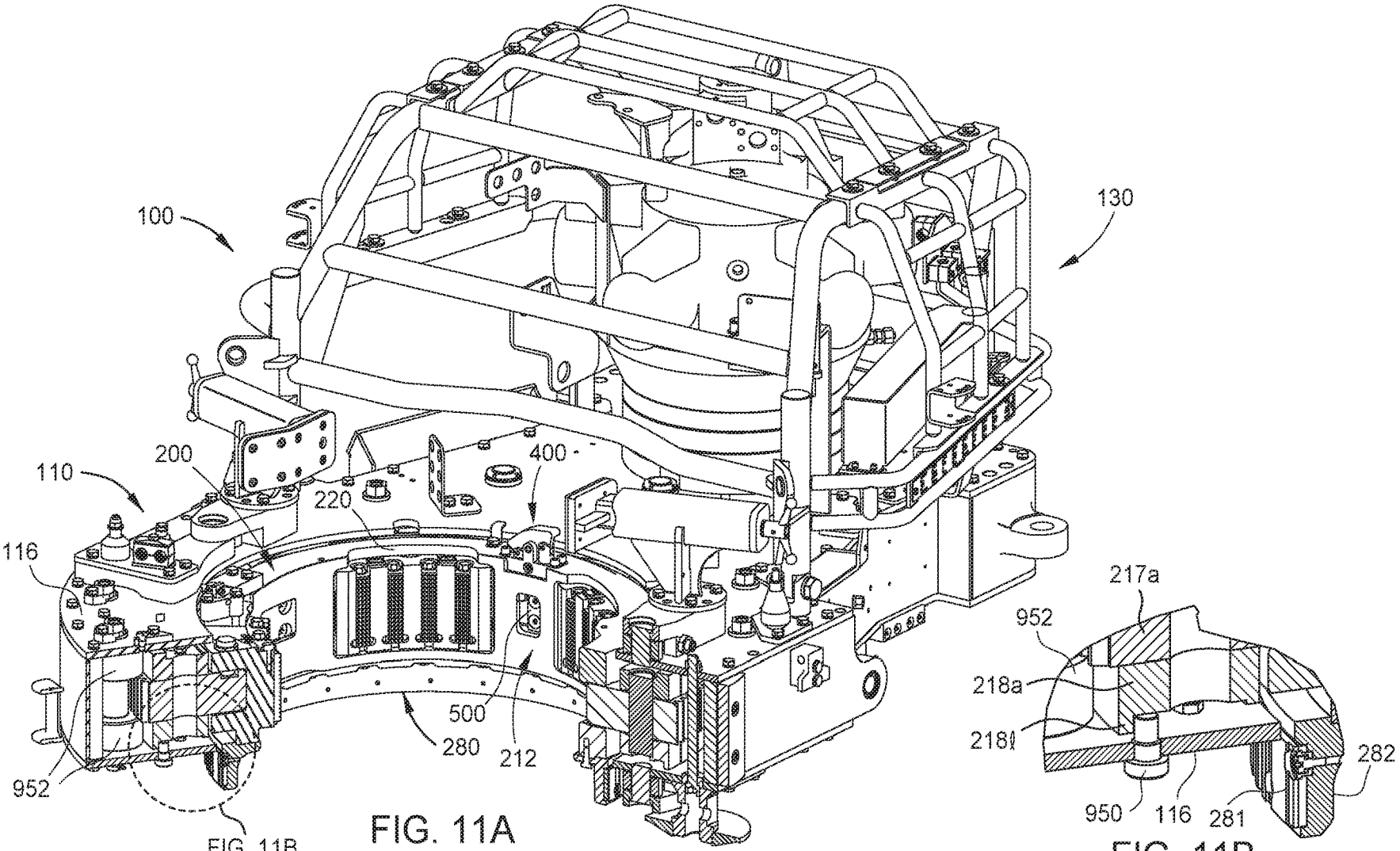
FIG. 11A is a partial cross sectional view of the tong assembly 100.
FIG. 11B is an enhanced view of FIG. 11A.

FIG. 11A is a partial cross section of one embodiment of the tong assembly 100. FIG. 11B illustrates a close up view of a portion of FIG. 11A. As shown in FIG. 11B, rollers 950 engage a lip 218*l* of the second body member 218 and rollers 952 engage a surface of the first body member 216 and second body member 218. The rollers 952 are disposed in the first and second body arms 116, 118. The rollers 950, 952 facilitate the rotation of the rotary gripping apparatus 200 relative to the tong body 112. Instead of, or in addition to, the first body arm 116 and the second body arm 118 being able to selectively grip the respective first and second rotary arm 206, 208, the first and second body arms 116, 118 include the one or more rollers 950. The engagement of the rollers 950 with the lip 218*l* allows the first and second body arms 116, 118 to move the respective first and second rotary arms 206, 208 to the open position. The rollers 952 additionally facilitate the closing of the rotary gripping apparatus 200 by pushing against the rotary arms 206, 208 as the first and second body arms 116, 118 close. In some embodiments, a retaining bolt can be used in lieu of or in addition to the rollers 950 to engage the lip 218*l* or 248*l*.

In one embodiment, the tong assembly 100 is used in a make-up operation to make-up a first tubular with a second tubular. First, the rotary gripping apparatus 200 is positioned in the neutral alignment and in the neutral orientation. Then, the rotary gripping apparatus 200 is opened to create the gap 210 by moving first body arm 116 and the second body arm 118 to the open position, which moves the first rotary arm 206 and second rotary arm 208 to the open position. The first tubular is then inserted into the gap 210. After centering the first tubular in the rotary gripping apparatus 200, or during the centering process, the rotary gripping apparatus 200 can be closed by closing the first and second body arms 116, 118 of the power tong 110, which closes the respective first and second rotary arm 206, 208 to close the gap 210. Then, the brake band assembly 140 moves the brake band 142 into engagement with the brake 280 to hold the jaw carrier 212 in a fixed position relative to the cam body 214. The drive gear of the power tong 110 rotates the cam body 214 in a first direction relative to jaw carrier 212 until the active jaws 222 extend into engagement with the first tubular and the cam body 214 becomes rotationally locked with jaw carrier 212. When the force applied by the drive gear exceeds the brake force applied by the brake band assembly 140 to the brake 280, the entire rotary gripping apparatus 200 is able to rotate relative to the other components of the power tong 110. With the first tubular gripped by the jaws 222, 244, the rotary gripping apparatus 200 is then rotated until make-up of the first tubular with the second tubular is complete. Once make-up of the first tubular is complete, the brake band assembly 140 re-engages the brake 280 to hold the jaw carrier 212 in a fixed position relative to the cam body 214. The drive gear of the power tong 110 rotates the cam body 214 in the opposite direction relative to the jaw carrier 212 to release the first tubular from the jaws 222, 244 until the neutral alignment is reached. The first tubular is released from the jaws 222, 244 because the active jaws 222 have disengaged from the first tubular. Then, the brake band assembly 140 may release the brake 280 allowing the drive gear to rotate the rotary gripping apparatus 200 to the neutral orientation with respect to the tong body 112 of the power tong 110. Then the first and second body arms 116, 118 are opened to open the rotary arms 206, 208 to form the gap 210. The process is repeated as necessary to make-up multiple joints of tubular. The backup tong 120 may be used to grip the second tubular during the make-up operation.

In one embodiment, the tong assembly 100 is used in a break-out operation to break-out a first tubular from a second tubular. First, the rotary gripping apparatus 200 is positioned in the neutral alignment and in the neutral orientation. Then, the rotary gripping apparatus 200 is opened to create the gap 210 by moving the first body arm 116 and second body arm 118 to the opened position, which moves the first rotary arm 206 and the second body arm 118 to the open position. The first tubular for the break-out operation is then inserted into the gap 210. After centering the first tubular in the rotary gripping apparatus 200, or during the centering process, the rotary gripping apparatus 200 is closed by closing the first and second body arms 116, 118, which also closes the respective first and second rotary arm 206, 208 to close the gap 210. Then, the brake band assembly 140 moves the brake band 142 into engagement with the brake 280 to hold the jaw carrier 212 in a fixed position relative to the cam body 214. The drive gear of the power tong 110 rotates the cam body 214 in a first direction relative to jaw carrier 212 until the active jaws 222 extend into engagement with the first tubular and the cam body 214 becomes rotationally locked with the jaw carrier 212. When the force applied by the drive gear exceeds the brake force applied by the brake band assembly 140 to the brake 280, the entire rotary gripping apparatus 200 is able to rotate relative to the other components of the power tong 110. With the first tubular gripped by the jaws 222, 244, the rotary gripping apparatus 200 is then rotated until break-out of the first tubular from the second tubular is complete. Once break-out of the first tubular is complete, the brake band assembly 140 re-engages the brake 280 to hold the jaw carrier 212 in a fixed position relative to the cam body 214. The drive gear of the power tong 110 rotates the cam body 214 relative to the jaw carrier 212 to release the first tubular from the jaws 222, 244 until the neutral alignment is reached. The first tubular is released from the jaws 222, 244 because the active jaws 222 have disengaged from the first tubular. Then, the brake band assembly 140 may release the brake 280 allowing the drive gear to rotate the rotary gripping apparatus 200 to the neutral orientation with respect to the tong body 112. Then the first and second body arms 116, 118 are opened to open the rotary arms 206, 208 to form the gap 210. The first tubular may then be removed from the rotary gripping apparatus 200 via the gap 210. The process is repeated as necessary to break-out multiple joints of first tubular. The backup tong 120 may be used to grip the second tubular during the break-out operation.

In some embodiments, the first rotary arm 206 and second rotary arm 208 may be moved together, or one rotary arm may be moved to the open position prior to the other rotary arm. In some embodiments, only one of the first and second rotary arms 206, 208 is opened to form the gap 210.

Figure 12:
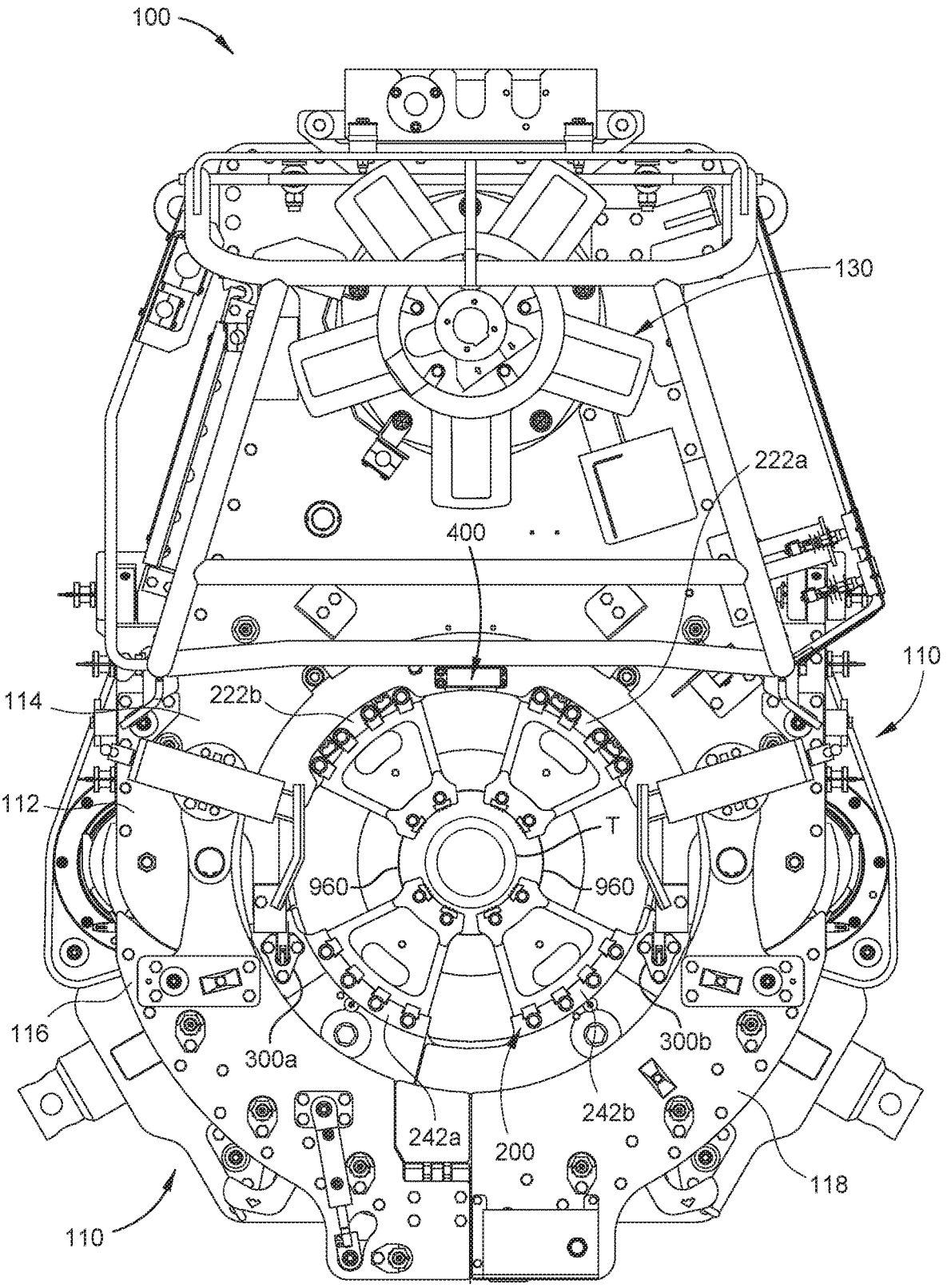
FIG. 12 is a top view of the tong assembly 100 illustrating the adapters 960.

In some embodiments, and as shown in FIG. 12, the active jaws 222 and/or the passive jaws 244 have adapters 960 that can be used for gripping tubulars having a small outer diameter, such as the tubular T. The adapters 960 may be fastened to the jaws 222, 244 by a bolt or screw connection.

FIGS. 13A-13D illustrates an alternative rotary gripping apparatus 1200 of the power tong 110. The drive gear of the power tong 110 rotates the rotary gripping apparatus 1200 about a central axis during a make-up or break-out operation. The rotary gripping apparatus 1200 has a rotary base 1204, a first rotary arm 1206, and a second rotary arm 1208. The first rotary arm 1206 and the second rotary arm 1208 are pivotable relative to the rotary base 1204 to convert the rotary gripping apparatus 1200 from a closed configuration to an open configuration when the rotary gripping apparatus 1200 is in a neutral alignment. When in the open configuration, a gap, such as gap 210, is present in the rotary gripping apparatus 1200 to allow ingress or egress of a tubular. When the rotary gripping apparatus 1200 is in a neutral orientation relative to the tong body 112, the first rotary arm 1206 is aligned with the first body arm 116 and the second rotary arm 1208 is aligned with the second body arm 118. When the rotary gripping apparatus 1200 is in the neutral orientation, the first body arm 116 and second body arm 118 are configured to move the first rotary arm 1206 and the second rotary arm 1208 to open, and then close, the rotary gripping apparatus 1200.

Figure 13A:
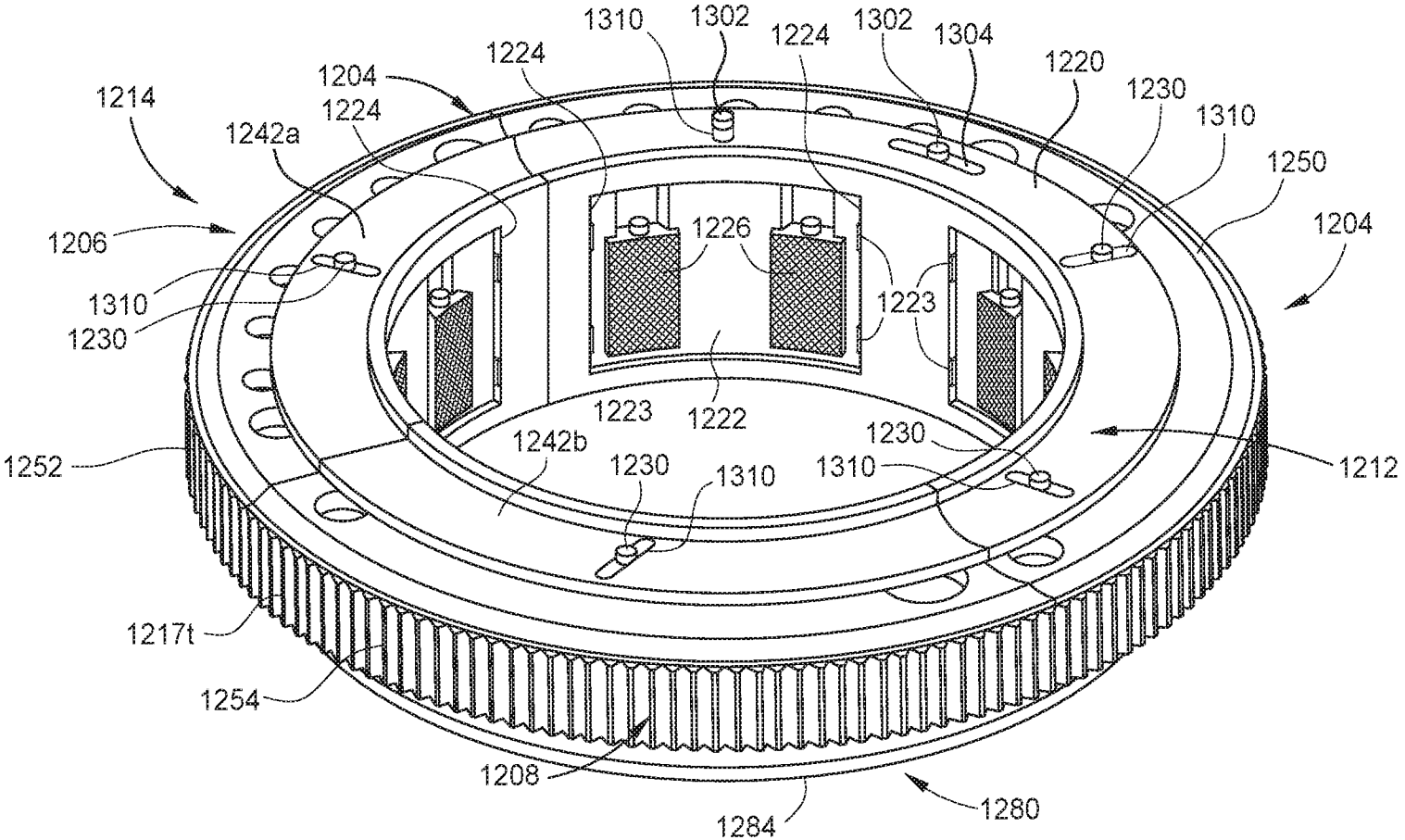
FIG. 13A illustrates an alternative rotary gripping apparatus 1200 in a closed configuration.
Figure 13B:
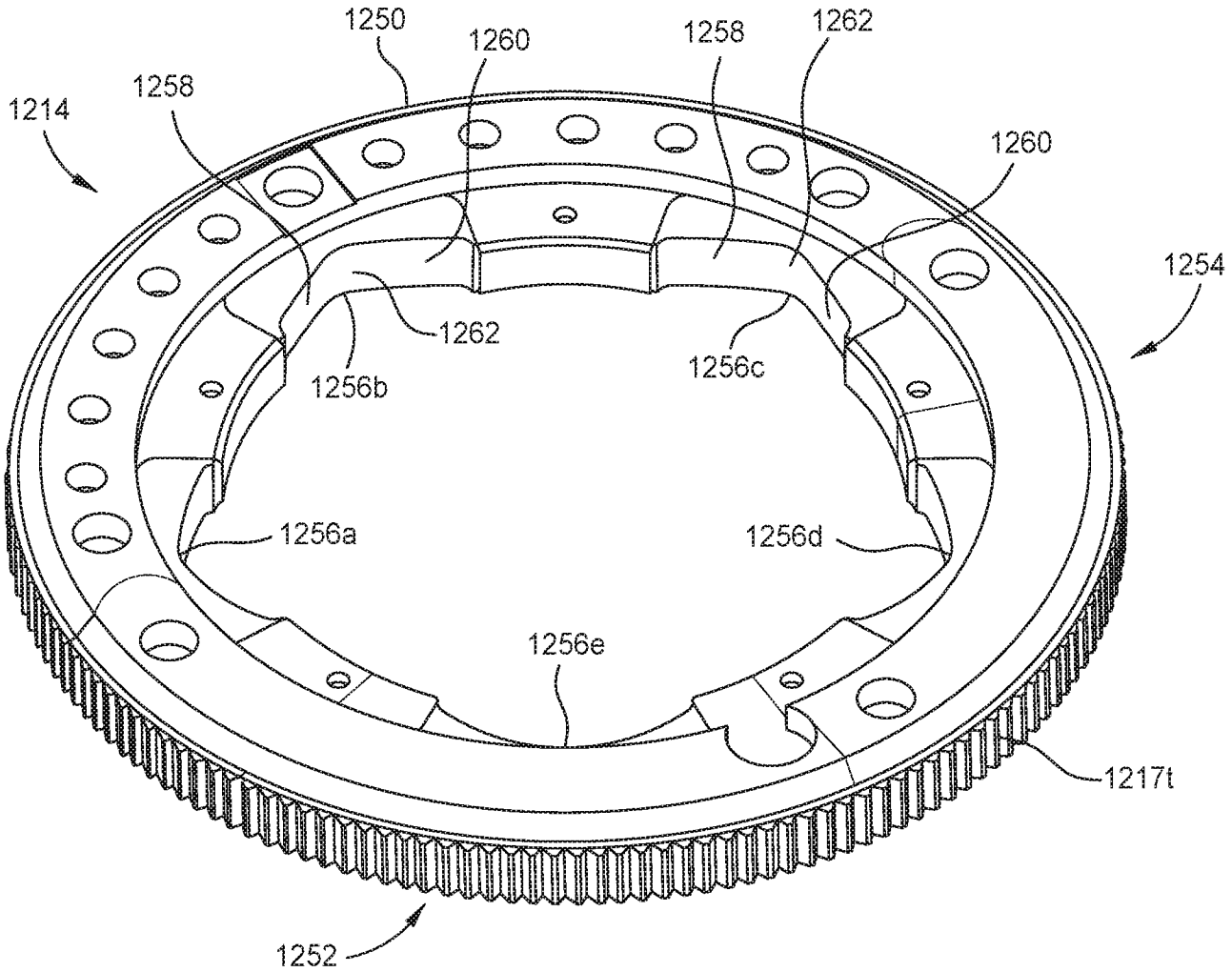
FIG. 13B illustrates the cam body 1214 of the rotary gripping apparatus 1200.
Figure 13C:
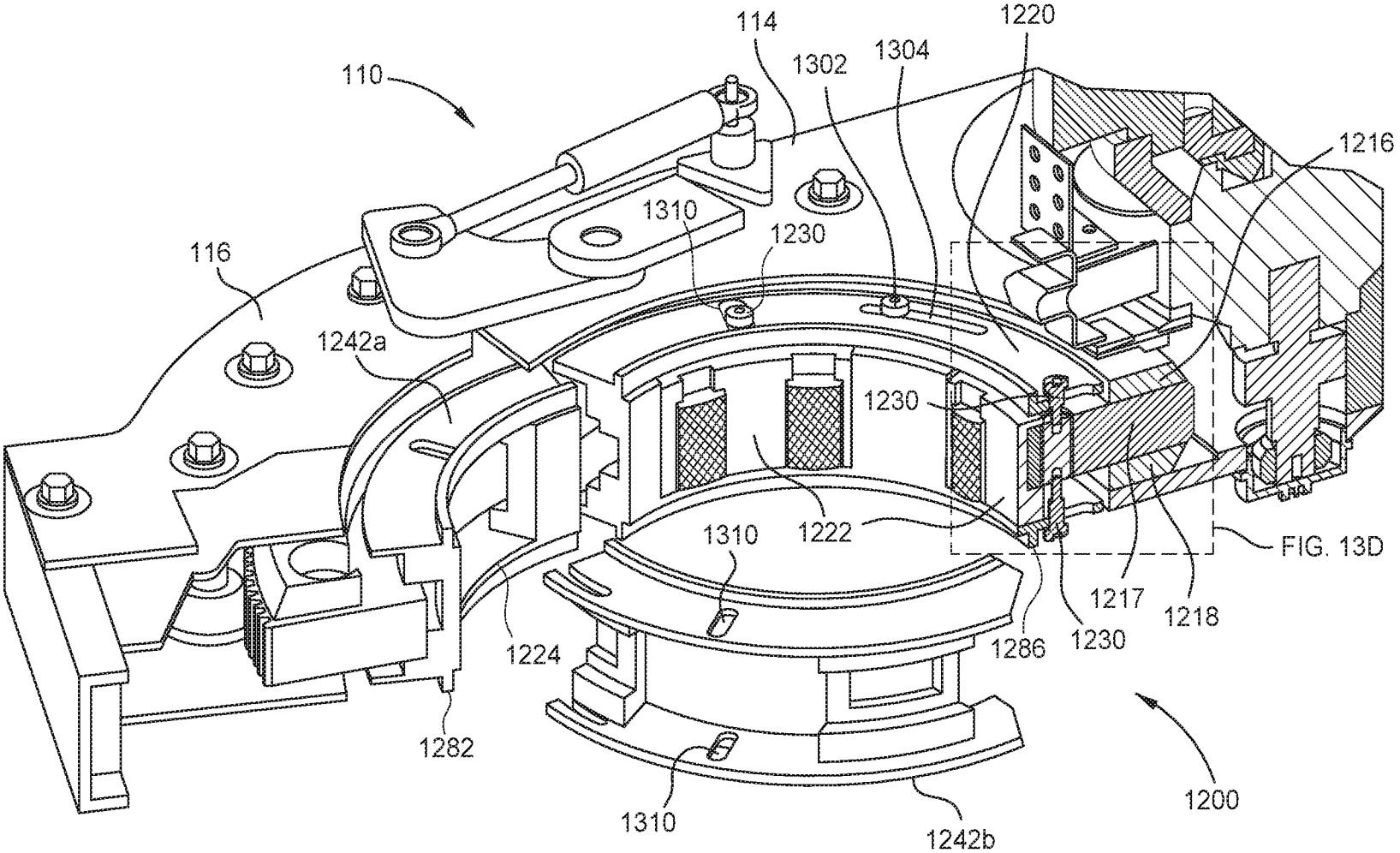
FIG. 13C is a partial cross sectional view of the rotary gripping apparatus 1200 and power tong 110.
Figure 13D:
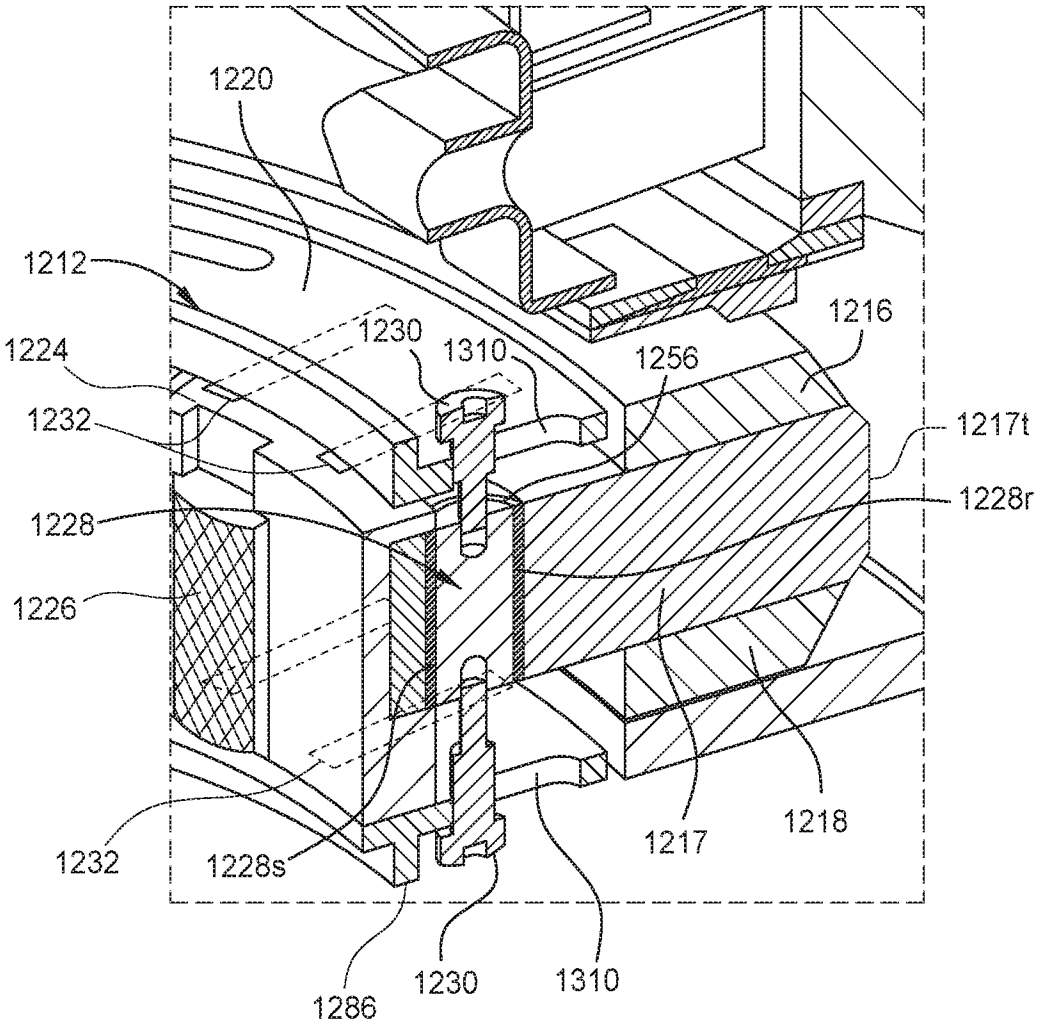
FIG. 13D is an enhanced view of FIG. 13C.

The rotary gripping apparatus 1200 has a jaw carrier 1212 and a cam body 1214. The jaw carrier 1212 includes a plurality of active jaws 1222 to engage a tubular. In this embodiment, the rotary gripping apparatus 1200 does not have any passive jaws. The jaw carrier 1212, as shown in FIG. 13A, has a jaw base 1220, a first jaw arm 1242*a*, and a second jaw arm 1242*b*. The jaw carrier 1212 has a plurality of active jaws 1222 disposed in jaw cavities 1224. A plurality of slide bearings 1232 are coupled to the jaw carrier 1212 and disposed in the jaw cavities 1224 to facilitate the radial movement of the active jaws 1222. Each active jaw 1222 has a body 1223, gripping elements 1226, a roller assembly 1228, and a follower member 1230. The roller assembly 1228 includes a shaft 1228*s* formed integrally with or attached to the body 1223, and a roller 1228*r* disposed about the shaft 1228*s*. In some embodiments, and as shown in FIG. 13D, the active jaw 1222 has two follower members 1230. Each follower member 1230 may be similar to follower member 230.

The jaw carrier 1212 additionally has a brake 1280 having a plurality of brake pads 1281. The brake 1280 has a first arm segment 1282, a second arm segment 1284, and a base segment 1286. The first arm segment 1282 may be attached to or integral with the first jaw arm 1242*a*. The second arm segment 1284 may be attached to or integral with the second jaw arm 1242*b*. The base segment 1286 may be attached to or integral with the jaw base 1220. When the rotary gripping apparatus 1200 is in the closed configuration, the brake 1280 forms an enclosed ring that can engage with a brake band 142 of the brake band assembly 140 to slow or stop the rotation of the rotary gripping apparatus 1200 and/or to hold the jaw carrier 1212 in a fixed position relative to the cam body 1214.

The cam body 1214 includes a cam base 1250, a first cam arm 1252, and a second cam arm 1254. Gear teeth 1217*t* are disposed about the circumference of the cam body 1214 and engage a drive gear of the power tong 110. The cam body 1214 has two or more cams 1256, such as five cams 1256*a-e* in FIG. 13B. Each cam 1256 of the cam body 1214 corresponds to a respective active jaw 1222 of the jaw carrier 1212. As shown in FIG. 13B, the cams 1256*a-c* are formed in the cam base 1250, cam 1256*d* is formed in the second cam arm 1254, and cam 1256*e* is formed in the first cam arm 1252. The cams 1256 of the rotary gripping apparatus 1200 are similar to cams 256 of the rotary gripping apparatus 200.

Each cam 1256 has a first cam face 1258, a second cam face 1260, and a third cam face 1262. The third cam face 1262 is disposed between the first cam face 1258 and the second cam face 1260. In some embodiments, the third cam face 1262 may be a recess. The first cam face 1258 and the second cam face 1260 are configured to engage with the roller assembly 1228 of the active jaw 1222 to move the active jaws 1222 between the radially extended position and the radially retracted positon, depending on the direction of rotation of the cam body 1214 relative to the jaw carrier 1212.

The first rotary arm 1206 includes the first jaw arm 1242*a*, the first arm segment 1282, and the first cam arm 1252. The second rotary arm 1208 includes the second jaw arm 1242*b*, the second arm segment 1284, and the second cam arm 1254 of the cam body 1214. When in the neutral alignment, the first rotary arm 1206 and the second rotary arm 1208 are pivotable relative to the rotary base 1204.

The active jaws 1222 are in the radially retracted position and the rotary gripping apparatus 1200 is in the neutral alignment when the roller assembly 1228 of the active jaw 1222 is engaged with the third cam face 1262. When in the neutral alignment, the jaw base 1220, the first jaw arm 1242*a*, and the second jaw arm 1242*b* are aligned with the cam base 1250, first cam arm 1252, and second cam arm 1254, respectively.

The cam body 1214 is rotated relative to the jaw carrier 1212 in a first direction to radially extend the active jaws 1222 from the radially retracted position. The cam body 1214 and the jaw carrier 1212 become rotationally locked together when the active jaws 1222 reach the limit of their extension. In some embodiments, the extension of active jaws 1222 can be limited by the engagement of the active jaws 1222 with the tubular or the engagement the roller assembly 1228 with a sidewall adjacent the cams 1256. The cam body 1214 is rotated relative to the jaw carrier 1212 in a second direction to radially retract the active jaws from the radially extended position.

In some embodiments, and as shown in FIG. 13A, the jaw carrier 1212 has one or more cam slots 1304. The one or more cam slots 1304 are configured to receive the one or more retainer members 1302 that are coupled to the cam body 1214. The retainer members 1302 retain the jaw carrier 1212 on the cam body 1214. The retainer member 1302 moves within the cam slot 1304 as the cam body 1214 moves relative to the jaw carrier 1212.

In some embodiments, the jaw carrier 1212 has a plurality of jaw slots 1310 corresponding to the follower members 1230 of each active jaw 1222. The follower member 1230 is partially disposed in the jaw slot 1310, and the follower member 1230 may move in the jaw slot 1310. The follower member 1230 and jaw slot 1310 guide the active jaws 1222 as they move between the radially extended and radially retracted position. The jaw slot 1310 and the follower member 1230 retain the active jaw 1222 on the jaw carrier 1212 and prevent the active jaws 1222 from falling out the jaw carrier 1212. In some embodiments, and as shown in FIGS. 13C-13D, the follower members 1230 are partially disposed in the shaft 1228*s* of the roller assembly 1228. In some embodiments, a biasing member, such as a spring, is disposed in the jaw cavity 1224 and is coupled to the active jaw 1222 and jaw carrier 1212. The biasing member biases the active jaw 1222 toward the retracted positon. For example, when the active jaw 1222 is moved to the radially extended position, the biasing member is stretched. When the cam body 1214 is rotated relative to the jaw carrier 1212 in the opposite direction, the biasing member contracts and pulls the active jaw 1222 back to the radially retracted position.

In some embodiments, the active jaws 1222 are guided back to the radially retracted position by the engagement of the follower member 1230 with a slot, like slot 264, formed in the cam body 1214 adjacent the cam 1256 instead of the jaw slots 1310. In some embodiments, a biasing member can be used in conjunction with the slot formed in the cam body 1214.

The active jaws 1222 move radially between the radially retracted and radially extend positons with substantially no lateral movement relative to the radius of the rotary gripping apparatus 1200 due to one or more slide bearings 1232 and the rolling engagement of the roller assembly 1228 with the cam 1256. Lateral movement of the active jaw 1222 relative to the radius of the rotary gripping apparatus 1200 is mitigated or does not occur at all. Thus, when an active jaw 1222 grips a tubular, it imparts no lateral forces, or substantially no lateral forces, to the tubular. The mitigation of lateral forces applied to the tubular by the active jaw 1222 decreases the chance that the active jaw 1222 fails to grip the tubular and decreases galling of the tubular.

In one embodiment, a first lock, such as lock 300*a* of the rotary gripping apparatus 200, is provided on the first jaw arm 1242*a* for attaching the first jaw arm 1242*a* to the first cam arm 1252 to form the first rotary arm 1206. A second lock, such as lock 300*b* of the rotary gripping apparatus 200, is provided on the second jaw arm 1242*b* for attaching the second jaw arm 1242*b* to the second cam arm 1254 to form the second rotary arm 1208. The first and second locks may correspond to release members, such as release members 320*a,b*, disposed on the jaw base 1220 to retain the first and second locks in an unlocked configuration.

In some embodiments, the first jaw arm 1242*a* and the second jaw arm 1242*b* have surfaces complementary to surfaces of the jaw base 1220 to maintain the vertical alignment of the first jaw arm 1242*a* and the second jaw arm 1242*b* with the jaw base 1220 when in the closed position and/or when the rotary gripping apparatus 1200 is in the closed configuration. The complementary surfaces of the jaw base 1220 may be disposed on a protrusion. The complementary surfaces of the first and second jaw arms 1242*a*, 1242*b* may be part of a recess configured to receive the protrusion of the jaw base 1220.

The cam body 1214 of the rotary gripping apparatus 1200 may have a stop key and a make/break switch. The make/break switch and stop key of the rotary gripping apparatus 1200 may be similar to make/break switch 400 and stop key 500 of the rotary gripping apparatus 200. In some embodiments, the interaction of the stop key and the make/break switch of the rotary gripping apparatus 1200 are configured to determine which direction the cam body 1214 rotates relative to the jaw carrier 1212 to radial extended the active jaws 1222 and configured to limit the rotation of the cam body 1214 relative to the jaw carrier 1212 when retracting the active jaws 1222 to place the rotary gripping apparatus 1200 in the neutral alignment.

In one embodiment, the tong assembly 100 having the rotary gripping apparatus 1200 is used in a make-up operation to make-up a first tubular with a second tubular. First, the rotary gripping apparatus 1200 is positioned in the neutral alignment and in the neutral orientation. Then, the rotary gripping apparatus 1200 is opened to create the gap by moving the first body arm 116 and second body arm 118 to open the first rotary arm 1206 and second rotary arm 1208. A first tubular is then inserted into the gap. After centering the first tubular in the rotary gripping apparatus 1200, or during the centering process, the rotary gripping apparatus 1200 can be closed by closing the first and second body arms 116, 118, which also close the respective first and second rotary arm 1206, 1208 to close the gap. Then, the brake band assembly 140 moves the brake band 142 into engagement with the brake 1280 to hold the jaw carrier 1212 in a fixed position relative to the cam body 1214. The drive gear of the power tong 110 rotates the cam body 1214 in a first direction relative to jaw carrier 1212 until the active jaws 1222 extend into engagement with the first tubular and the cam body 1214 becomes rotationally locked with the jaw carrier 1212. When the force applied by the drive gear exceeds the brake force applied by the brake band assembly 140 to the brake 1280, the entire rotary gripping apparatus 1200 is able to rotate relative to the other components of the power tong 110. With the first tubular gripped by the active jaws 1222, the rotary gripping apparatus 1200 is then rotated until make-up is complete. Once make-up of the first tubular is complete, the brake band assembly 140 re-engages the brake 1280 to hold the jaw carrier 1212 in a fixed position relative to the cam body 1214. The drive gear of the power tong 110 rotates the cam body 1214 in the opposite direction relative to the jaw carrier 1212 to release the first tubular from the active jaws 1222. The cam body 1214 is rotated until the neutral alignment is reached. Then, the brake band assembly 140 may release the brake 1280 allowing the drive gear to rotate the rotary gripping apparatus 1200 to the neutral orientation with respect to the tong body 112. Then the first and second body arms 116, 118 are opened to open the first and second rotary arms 1206, 1208. The process is repeated as necessary to make-up multiple joints of first tubular. The backup tong 120 may be used to grip the second tubular during the make-up operation.

In one embodiment, the tong assembly 100 having the rotary gripping apparatus 1200 is used in a break-out operation to break-out a first tubular from a second tubular. First, the rotary gripping apparatus 1200 is positioned in the neutral alignment and in the neutral orientation. Then, the rotary gripping apparatus 1200 is opened to create the gap by moving the first body arm 116 and second body arm 118 to open the first rotary arm 1206 and second rotary arm 1208. A first tubular for the break-out operation is then inserted into the gap. After centering the first tubular in the rotary gripping apparatus 1200, or during the centering process, the rotary gripping apparatus 1200 can be closed by closing the first and second body arms 116, 118, which also closes the respective first and second rotary arms 1206, 1208. Then, the brake band assembly 140 moves the brake band 142 into engagement with the brake 1280 to hold the jaw carrier 1212 in a fixed position relative to the cam body 1214. The drive gear of the power tong 110 rotates the cam body 1214 in a first direction relative to jaw carrier 1212 until the active jaws 1222 extend into engagement with the first tubular and the cam body 1214 becomes rotationally locked with the jaw carrier 1212. When the force applied by the drive gear exceeds the brake force applied by the brake band assembly 140 to the brake 1280, the entire rotary gripping apparatus 1200 is able to rotate relative to the other components of the power tong 110. With the first tubular gripped by the active jaws 1222, the rotary gripping apparatus 1200 is then rotated until break-out of the first tubular is complete. Once break-out of the first tubular is complete, the brake band assembly 140 re-engages the brake 1280 to hold the jaw carrier 1212 in a fixed position relative to the cam body 1214. The drive gear of the power tong 110 rotates the cam body 1214 relative to the jaw carrier 1212 to release the first tubular from the active jaws 1222. The rotary gripping apparatus 1200 is rotated until the neutral alignment is reached. Then, the brake band assembly 140 may release the brake 1280 allowing the drive gear to rotate the rotary gripping apparatus 1200 to the neutral orientation with respect to the tong body 112. Then the first and second body arms 116, 118 are opened to open the first and second rotary arms 1206, 1208 for removal of the first tubular. The process is repeated as necessary to break-out multiple joints of first tubular. The backup tong 120 may be used to grip the second tubular during the break-out operation.

In some embodiments, the cam body 1214 is formed from a first body member 1216, a gear member 1217, and a second body member 1218. The first body member 1216 of the rotary gripping apparatus 1200 may be similar to the first body member 216 of the rotary gripping apparatus 200. The gear member 1217 of the rotary gripping apparatus 1200 may be similar to the gear member 217 of the rotary gripping apparatus 200. The second body member 1218 of the rotary gripping apparatus 1200 may be similar to the second body member 218 of the rotary gripping apparatus 200.

In some embodiments, the first rotary arm 1206 and second rotary arm 1208 may be moved together, or one rotary arm may be moved to the open position prior to the other rotary arm. In some embodiments, only one of the first rotary arm 1206 and second rotary arm 1208 is moved to form the gap.

In some embodiments, the rotary gripping apparatus 1200 may include one or more components of the rotary gripping apparatus 200. In some embodiments, the rotary gripping apparatus 200 may include one or more components of the rotary gripping apparatus 1200.

In some embodiment, the rotary gripping apparatus 1200 may have adapters, such as adapters 960, attached to the active jaws 1222 to grip tubulars having small outer diameters.

In some embodiments, the rotary gripping apparatus has only one rotary arm. The one rotary arm has one or more passive jaw assemblies corresponding to one or more active jaws disposed in the active jaw portion of the jaw carrier. The one rotary arm is moved between the closed position and the open position to open and close the gap. In some embodiments of the rotary gripping apparatus having only one rotary arm, one or more active jaws are disposed in the rotary arm that correspond to one or more active jaws disposed in a jaw base of the jaw carrier.

The tubular gripped by the rotary gripping apparatus can be a drill pipe, casing, production pipe, or any suitable tubular used in creating a wellbore or the production of oil and/or gas from the wellbore.

In some embodiments, the gap 210 of the rotary gripping apparatus 200 and the gap of the rotary gripping apparatus 1200 is an opening.

In some embodiments, the roller assemblies 228, 1228 may be a roller shaft without a roller surrounding the shaft.

In some embodiments, the cam body is rotatable relative to the jaw carrier by about 20 degrees. In some embodiments, the cam body is rotatable relative to the jaw carrier by less than about 20 degrees, such as by about 17 degrees. In some embodiments, the cam body is rotatable relative to the jaw carrier by more than about 20 degrees.

In some embodiments, the rotary gripping apparatus is placed in the neutral alignment and neutral alignment at the same time prior to opening the rotary arms to form the gap.

In some embodiments, the tubular may be inserted into and removed from the gap of the rotary gripping apparatus 200, 1200 by moving the tong assembly 100 relative to the tubular, such as by moving the tong assembly 100 with a positioning arm.

In one embodiment, a power tong for handling a tubular includes a rotary gripping apparatus including a rotary base having a first jaw, and at least one rotary arm movable relative to the rotary base between an open position and a closed position, the at least one rotary arm having a second jaw. A gap is present between the rotary base and the at least one rotary arm for receiving the tubular when the at least one rotary arm is in the open position, and wherein the gap is closed when the at least one rotary arm is in the closed position.

In some embodiments, the first jaw is an active jaw and the second jaw is a passive jaw.

In some embodiments, the at least one rotary arm includes a first rotary arm and a second rotary arm.

In some embodiments, the rotary gripping apparatus comprises a jaw carrier and a cam body, and the cam body is rotatable relative to the jaw carrier to move the first jaw from a radially retracted to a radially extended position relative to the jaw carrier.

In some embodiments, the cam body is rotatable relative to the jaw carrier to move the second jaw from the radially retracted to the radially extended position relative to the jaw carrier.

In some embodiments, the second jaw is a passive jaw.

In some embodiments, a direction of rotation of the cam body relative to the jaw carrier to extend the first jaw is controlled by a switch.

In some embodiments, the power tong includes a brake band assembly having a brake band, wherein the brake band is configured to selectively engage a brake of the rotary gripping apparatus.

In one embodiment, a rotary gripping apparatus for a power tong includes a jaw carrier having a passive jaw assembly having a passive jaw, and an active jaw movable from a retracted position to an extended position. The rotary gripping apparatus further includes cam body disposed about the jaw carrier and rotatable relative to the cam body, the cam body having a cam base having a cam configured to radially extend the active jaw from the retracted position to the extended position, and a cam arm movable relative to the cam base. The passive jaw assembly is movable with the cam arm relative to the cam base to create an opening in the cam body.

In some embodiments, the jaw carrier has a lock configured to selectively attach the passive jaw assembly to the cam arm.

In some embodiments, the passive jaw assembly includes an arm alignment assembly.

In some embodiments, the arm alignment assembly is an alignment member attached to the passive jaw assembly and slidably disposed in a slot of the cam arm.

In some embodiments, the active jaw includes a roller assembly configured to engage the cam, wherein the roller assembly is configured to move the active jaw from the retracted position to the extended position as roller assembly slides along the cam. The active jaw further includes a follower member configured to follow a slot of the cam body adjacent to the cam, wherein the follower member and slot are configured to move the active jaw from the extended position to the retracted position.

In some embodiments, the jaw carrier has at least one slide bearing configured to guide the active jaw from the retracted position to the extended position.

In some embodiments, the jaw carrier has a make/break switch having a stop member and the cam body has a stop key, wherein the cam body and jaw carrier are in a neutral alignment when the stop member is engaged with the stop key.

In some embodiments, the cam body is rotatable relative to the jaw carrier in a first direction to move the active jaw from the retracted position to the extended position. The cam body is rotatable relative to the jaw carrier in a second direction to move the active jaw from the extended position to the radially retracted position. The cam body is in a neutral alignment with the jaw carrier when the active jaw is in the retracted position.

In some embodiments, the jaw carrier includes a brake having a plurality of brake pads.

In one embodiment, a rotary gripping apparatus for use with a power tong includes a jaw carrier having a plurality of active jaws movable from a retracted position to an extended position, the jaw carrier having a first jaw arm. The rotary gripping apparatus further includes a cam body having a plurality of cams, each cam of the plurality of cams corresponding to an individual active jaw of the plurality of active jaws, wherein the cam body is rotatable in a first direction to extend the plurality of active jaws with the plurality of cams, and wherein the cam body has a first cam arm. The first jaw arm and the first cam arm are movable from a first position to a second position to create a gap.

In some embodiments, the cam body is rotated in a second direction to retract the plurality of active jaws and to place the cam body in a neutral alignment with the jaw carrier.

In some embodiments, the first jaw arm includes at least one active jaw of the plurality of active jaws, and the first cam arm has at least one cam of the plurality of cams.

In some embodiments, the rotary gripping apparatus further includes a retainer member disposed in a first slot and configured to retain jaw carrier on the cam body.

In some embodiments, wherein the jaw carrier includes a second slot, and wherein the plurality of active jaws includes a follower member disposed in the second slot configured to guide the jaw carrier from the retracted position to the extended position.

In some embodiments, wherein the first slot and the second slot are configured to limit the extension of the plurality of active jaws.

In one embodiment, a tong assembly includes a power tong having a rotary gripping apparatus. The rotary gripping apparatus including a plurality of jaws, a rotary base and a first rotary arm, wherein the first rotary arm is movable from a first position to a second position to create an opening in the rotary gripping apparatus. The power tong further includes a first body arm configured to selectively move the first rotary arm from the first position to the second position. The rotary gripping apparatus is rotatable relative to the first body arm.

In some embodiments, the rotary gripping apparatus further including a brake.

In some embodiments, the power tong further including brake band assembly configured to selectively engage the brake of the rotary griping apparatus.

In some embodiments, the power tong further comprising a second body arm, the rotary gripping apparatus includes a second rotary arm movable relative to the rotary base, wherein the opening is created between the first rotary arm and the second rotary arm; and wherein the second body arm is configured to move the second rotary arm relative to the rotary base.

In some embodiments, the tong assembly further includes a backup tong.

In one embodiment, a method of rotating a tubular with a power tong includes opening a rotary gripping apparatus to receive the tubular, wherein the rotary gripping apparatus includes a jaw carrier including at least one active jaw and a cam body. The method further includes inserting the tubular into the open rotary gripping apparatus. The method further includes closing the rotary griping apparatus. The method further includes rotating the cam body relative to the jaw carrier to radially extend the at least one active jaws into engagement with the tubular. The method further includes rotating the tubular gripped by the at least one active jaws.

In some embodiments, prior to rotating the cam body relative to the jaw carrier to radially extend the at least one active jaw, a brake of the jaw carrier is engaged by a brake band assembly of the power tong.

In some embodiments, prior to opening the rotary gripping apparatus, the rotary gripping apparatus is rotated to a neutral orientation relative to a tong body of the power tong.

In some embodiments, opening the rotary gripping apparatus to remove the tubular occurs after rotating the tubular.

In one embodiment, a method includes rotating a rotary gripping assembly of a power tong in a closed configuration and having a plurality of jaws engaged with a first tubular in a first direction to make-up the first tubular with a second tubular. The rotary gripping apparatus includes a jaw carrier having a brake and the plurality of jaws and a cam body. The method further includes engaging a brake band assembly with the brake of the jaw carrier and then rotating the cam body relative to the jaw carrier to disengage the jaws from the first tubular. The method further includes actuating a first body arm of the power tong to convert the rotary gripping apparatus from the closed configuration to an open configuration to create a gap in the rotary gripping apparatus. The method further includes inserting a third tubular into the rotary gripping apparatus through the gap.

In some embodiments, the method further includes actuating the first body arm of the power tong to convert the rotary gripping apparatus from the open configuration to the closed configuration to close the gap.

In some embodiments, the method further includes engaging the brake band assembly with the brake and then rotating the cam body relative to the jaw carrier to engage the plurality of jaws with the third tubular.

In some embodiments, the method further includes rotating the rotary gripping apparatus to make-up the third tubular with a fourth tubular.

In some embodiments of the method, prior to actuating the first body arm of the power tong to convert the rotary gripping apparatus from the closed configuration to the open configuration, rotating the rotary gripping apparatus to a neutral orientation.

In some embodiments of the method, prior to rotating the power tong to a neutral orientation, rotating the cam body to a neutral alignment relative to the jaw carrier.

While the foregoing is directed to embodiments of the present disclosure, other and further embodiments of the disclosure may be devised without departing from the basic scope thereof, and the scope thereof is determined by the claims that follow.

What is claimed is:

1. A power tong for handling a tubular, comprising:
a rotary gripping apparatus including:
a rotary base including:
a cam base of a cam body including a first cam; and
a jaw base of a jaw carrier that includes a first jaw disposed in a first jaw cavity;
at least one rotary arm movable relative to the rotary base between an open position and a closed position, the at least one rotary arm including:
a cam arm of the cam body; and
a jaw arm of the jaw carrier including a second jaw,
wherein the cam body is rotatable relative to the jaw carrier when the at least one rotary arm is in the closed position,
wherein a gap is present between the rotary base and the at least one rotary arm for receiving the tubular when the at least one rotary arm is in the open position, and
wherein the gap is closed when the at least one rotary arm is in the closed position.

2. The power tong of claim 1, wherein the at least one rotary arm includes a first rotary arm and a second rotary arm.

3. The power tong of claim 1, wherein the cam body is rotatable relative to the jaw carrier to move the second jaw relative to the jaw arm from a radially retracted to a radially extended position relative to the jaw arm.

4. The power tong of claim 1, wherein the jaw is a passive jaw that is not radially movable with respect to the jaw arm.

5. The power tong of claim 1, further comprising:
a switch, wherein:
the switch is attached to the jaw base; and
the switch determines a direction of rotation of the cam body relative to the jaw carrier to move the first jaw between a radially retracted position and a radially extended position.

6. The power tong of claim 1, further comprising:
a brake including a brake base segment coupled to the jaw base and a brake arm segment coupled to the jaw arm; and
a brake band assembly including a brake band configured to selectively engage the brake.

7. The power tong of claim 1, wherein the first jaw includes:
a roller assembly configured to engage the first cam, wherein the roller assembly is configured to move the first jaw from a radially retracted position to a radially extended position as the roller assembly slides along the first cam; and
a follower member configured to follow a slot of the cam body adjacent to the first cam, wherein the follower member and slot are configured to move the first jaw from the radially extended position to the radially retracted position.

8. The power tong of claim 1, wherein the rotary gripping apparatus is opened or closed in a neutral alignment, wherein the rotary gripping apparatus is in a neutral alignment when the jaw base is aligned with the cam base and the jaw arm is aligned with the cam arm.

9. The power tong of claim 1, wherein the jaw carrier has a lock configured to selectively attach the passive jaw assembly to the cam arm when the rotary gripping apparatus is in the open position.

10. A rotary gripping apparatus for a power tong, comprising:
a jaw carrier including:
a passive jaw assembly including a passive jaw;
a jaw carrier cavity;
an active jaw disposed in the jaw carrier cavity and movable relative to the jaw carrier in the jaw cavity between a radially retracted position and a radially extended position; and
a cam body disposed about the jaw carrier and rotatable relative to the jaw carrier, the cam body including:
a cam base including a cam configured to move the active jaw from the radially retracted position to the radially extended position; and
a cam arm movable relative to the cam base;
wherein the passive jaw assembly is movable with the cam arm relative to the cam base to create an opening in the cam body.

11. The rotary gripping apparatus of claim 10, wherein the jaw carrier has a lock configured to selectively attach the passive jaw assembly to the cam arm.

12. The rotary gripping apparatus of claim 10, wherein the passive jaw assembly includes an arm alignment assembly comprising an alignment member disposed in a slot formed in the cam arm, wherein the slot and the alignment member are configured to interact to guide relative rotational movement between the cam body and the jaw carrier.

13. The rotary gripping apparatus of claim 10, wherein the active jaw includes:
a roller assembly configured to engage the cam, wherein the roller assembly is configured to move the active jaw from the retracted position to the extended position as the roller assembly slides along the cam;

a follower member configured to follow a slot of the cam body adjacent to the cam, wherein the follower member and slot are configured to move the active jaw from the extended position to the retracted position.

14. The rotary gripping apparatus of claim 10, wherein the jaw carrier has at least one slide bearing configured to guide the active jaw from the retracted position to the extended position.

15. The rotary gripping apparatus of claim 10, wherein the jaw carrier has a make/break switch including a stop member and the cam body has a stop key, wherein the cam body and jaw carrier are in a neutral alignment when the stop member is engaged with the stop key.

16. The rotary gripping apparatus of claim 10, wherein the cam body is rotatable relative to the jaw carrier in a first direction to move the active jaw from the retracted position to the extended position, and wherein the cam body is rotatable relative to the jaw carrier in a second direction to move the active jaw from the extended position to the radially retracted position, wherein the cam body is in a neutral alignment with the jaw carrier when the active jaw is in the retracted position.

17. A method of rotating a tubular with a power tong, comprising:

opening a rotary gripping apparatus to receive the tubular, wherein the rotary gripping apparatus includes:

a cam body including a cam base and a cam arm; and a jaw carrier including a jaw base, a jaw arm, and at least one active jaw, wherein the cam arm is pivotally attached to the cam base and opening the rotary gripping apparatus includes pivoting the cam arm relative to the cam base;

inserting the tubular into the open rotary gripping apparatus;

closing the rotary griping apparatus;

rotating the cam body relative to the jaw carrier to radially extend the at least one active jaws into engagement with the tubular; and rotating the tubular gripped by the at least one active jaws.

18. The method of claim 17, wherein prior to rotating the cam body relative to the jaw carrier to radially extend the at least one active jaw, a brake of the jaw carrier is engaged by a brake band assembly of the power tong.

19. The method of claim 17, wherein prior to opening the rotary gripping apparatus, the rotary gripping apparatus is rotated to a neutral orientation relative to a tong body of the power tong.

20. The method of claim 17, opening the rotary gripping apparatus to remove the tubular after rotating the tubular.

* * * * *